US005596349A

United States Patent [19]

Kobayashi et al.

[11] Patent Number: 5,596,349

[45] Date of Patent: Jan. 21, 1997

[54] IMAGE INFORMATION PROCESSOR

[75] Inventors: Mitsugu Kobayashi, Nagoya; Makoto Fujioka, Ogaki; Atsuyoshi Tanioka, Gifu; Kazuhiko Moriwaki, Gifu; Makoto Shimizu, Gifu; Hisao Uehara, Gifu, all of Japan

[73] Assignee: Sanyo Electric Co., Inc., Osaka, Japan

[21] Appl. No.: 128,476

[22] Filed: Sep. 28, 1993

[30] Foreign Application Priority Data

| | | | |
|---|---|---|---|
| Sep. 30, 1992 | [JP] | Japan | 4-262174 |
| Sep. 30, 1992 | [JP] | Japan | 4-262175 |
| Oct. 2, 1992 | [JP] | Japan | 4-264873 |
| Oct. 23, 1992 | [JP] | Japan | 4-286054 |
| Oct. 23, 1992 | [JP] | Japan | 4-286055 |
| Nov. 17, 1992 | [JP] | Japan | 4-307210 |
| Nov. 17, 1992 | [JP] | Japan | 4-307211 |
| Nov. 18, 1992 | [JP] | Japan | 4-308856 |
| Nov. 26, 1992 | [JP] | Japan | 4-316751 |
| Feb. 17, 1993 | [JP] | Japan | 5-028155 |

[51] Int. Cl.[6] ..... G09G 5/10

[52] U.S. Cl. ..... 345/147; 382/252

[58] Field of Search ..... 345/147–149, 345/150–155; 348/607, 412, 415, 416, 417, 418, 419, 422; 358/461, 46; 382/54, 236, 252, 274

[56] References Cited

U.S. PATENT DOCUMENTS

| | | | |
|---|---|---|---|
| 4,672,368 | 6/1987 | Williams | 345/155 |
| 5,068,914 | 11/1991 | Klees | 348/607 |
| 5,155,594 | 10/1992 | Bernstein et al. | 348/412 |
| 5,170,152 | 12/1992 | Taylor | 345/155 |
| 5,254,982 | 10/1993 | Feigenblatt | 345/148 |
| 5,283,646 | 2/1994 | Bruder | 348/415 |
| 5,289,294 | 2/1994 | Fujisawa | 358/461 |
| 5,450,098 | 9/1995 | Oz | 345/154 |

OTHER PUBLICATIONS

Floyd et al, 4.3: An Adaptive Algorithm for Spatial Grey Sacle, SID 75 Digest (1975).

Hirose et al., 32.2:5–bit TV Pictures on 3–bit Color TFT LCDs Using Alternating Dither, SID 92 Digest (1992).

Kobayashi et al, P–8: Multi–Gay–Level Method for TFT–LCD Using Enhanced Error Diffusion, SID 93 Digest (1993).

*Primary Examiner*—Steven Saras

*Attorney, Agent, or Firm*—Loeb & Loeb LLP

[57] ABSTRACT

An image information processor for a liquid crystal display by a digital driver is intended to provide image display near to a source image by making continuous-tone image display by pseudo representations. The image information processor generates L-bit image display data based on P-bit source image data, L being less than P. Added to source image data of a picture element of the Nth frame (where N is a natural number of 2 or greater) is error data corresponding to the picture element of the (N–1)th frame at the same position as the picture element of the Nth frame. The high-order L bits of the P-bit data resulting from the addition are used as image display data of the picture element of the Nth frame and at least one bit of the remaining low-order bit data is held as error data of the picture element of the Nth frame. Thus, error data of a picture element of one frame is added to the same picture element of the next frame, thereby lessening the brightness difference between both the picture elements and smoothing a time change in brightness.

7 Claims, 23 Drawing Sheets

IMAGE INFORMATION PROCESSOR

BACKGROUND OF THE INVENTION

1. Field of the Invention

This invention relates to an image processor and more particularly to an image processor for making continuous-tone image display of a liquid crystal display (LCD) by a digital driver.

2. Description of the Related Art

A method generally called time series operation processing, namely, a method of image processing by assuming a number of frames to be one screen (hereinafter, one unit of the image processing is referred to as a time series information pattern) is known as an image processing method according to conventional examples, especially for making continuous-tone image display of an LCD.

The time series operation processing (FRC) is described with reference to FIG. 1, wherein only red is discussed because green and blue are handled as red is.

A time series arithmetic processing unit according to a conventional example consists of a dot counter 21, a line counter 22, a frame counter 23, a gradation control circuit 24, a selector 25, and an adder 26, as shown in FIG. 1.

In FIG. 1, He is a horizontal synchronizing signal, Ve is a vertical horizontal synchronizing signal, and CKe is a dot clock. Eight bits of source image data corresponding to red are R0 to R7. The 8-bit data is divided into high-order six bits and low-order two bits which are used as data concerning four scales added.

Among the eight data bits R0 to R7, R7 is the most significant bit (MSB) and R0 is the least significant bit (LSB). The high-order six bits R2 to R7 take values 0 to 63 indicating 64 scales, as listed under values a in Table 1. The six bits are input to the adder 26 which then adds 1 to the 6-bit value to generate 6-bit data r2 to r7, as listed under values b in Table 1. Table 1 is a table for comparing values a and b.

TABLE 1

| Value a | | | | | | | Value b | | | | | | |
|---|---|---|---|---|---|---|---|---|---|---|---|---|---|
| R7 | R6 | R5 | R4 | R3 | R2 | Value | r7 | r6 | r5 | r4 | r3 | r2 | Value |
| 1 | 1 | 1 | 1 | 1 | 1 | 63 | 1 | 1 | 1 | 1 | 1 | 1 | 63 |
| 1 | 1 | 1 | 1 | 1 | 0 | 62 | 1 | 1 | 1 | 1 | 1 | 1 | 63 |
| 1 | 1 | 1 | 1 | 0 | 1 | 61 | 1 | 1 | 1 | 1 | 1 | 0 | 62 |
| 1 | 1 | 1 | 1 | 0 | 0 | 60 | 1 | 1 | 1 | 1 | 0 | 1 | 61 |
| — | — | — | — | — | — | — | — | — | — | — | — | — | — |
| 0 | 0 | 0 | 0 | 1 | 0 | 2 | 0 | 0 | 0 | 0 | 1 | 1 | 3 |
| 0 | 0 | 0 | 0 | 0 | 1 | 1 | 0 | 0 | 0 | 0 | 1 | 0 | 2 |
| 0 | 0 | 0 | 0 | 0 | 0 | 0 | 0 | 0 | 0 | 0 | 0 | 1 | 1 |

Next, Ve is fed into the frame counter 23 to generate a signal whose period is twice that of Ve, V0, and a signal whose period is four times that of Ve, V1. Frame numbers 0–3 are determined by the value of V1 and V0, and are repeated together with Ve. A signal whose period is twice that of CKe, C0, and a signal whose period is four times that of CKe, C1, are generated by the dot counter 21 with CKe as a clock like the frame counter 23. Likewise, H0 and H1 are generated by the line counter 22 by using He as a clock.

The gradation control circuit 24 generates a time series information pattern with four frames as one cycle by using 16 dots (horizontal four dots x vertical four dots) as one unit. Next, four scales indicated by the low-order two data bits R0 and R1 are considered and a time series information pattern in response to each scale is considered. 0 or 1 is given to each dot of the time series information pattern (one period or cycle: Horizontal four dots x vertical four dots x four frames) to define the average values of one period so that they become in the gradation order of four scales for each dot. Reduction of flickering is intended according to how to give 0 or 1.

Based on the time series information pattern, a control signal (STR) is generated for the selector 25 to select value a or b. First, a time series information pattern corresponding to the scale indicated by the low-order two data bits R0 and R1 is selected. Next, frames are distinguished from each other by V0 and V1 output from the frame counter 23. Further, a horizontal dot is selected by C0 and C1 output from the dot counter 21 and a vertical dot is selected by H0 and H1 output from the line counter 22. The value of the specified one point becomes the control signal (STR).

The control signal (STR) thus generated controls the selector 25 to output value a when the signal is 0 or value b when 1. Here, the specified one point is noted. The control signal (STR) selectively outputs value a or b, as listed in Table 2, in response to the data number 0–3 specified by the low-order two data bits R0 and R1 and the frame number 0–3. By the fact that value b is provided by adding 1 to value a for the one dot specified by the data number (R0, R1), the average values of four frames become a a+0.25 a+0.5 a+0.75 with respect to the data numbers 0 to 3 respectively, as listed in Table 2. This shows that four scales into which gradation is further divided between the scale corresponding to the value a (digital) and the scale corresponding to the value b greater by one than the value a are displayed as averages. Although only red is discussed here, similar processing is performed for green and blue. Table 2 is a table listing the data numbers and the frame numbers by the control signal (STR) and the average values of brightness.

Eight-bit data is compressed into 6-bit data for making continuous-tone image display by the time series operation processing as described above.

TABLE 2

| | Values by STR and average values | | | | |
|---|---|---|---|---|---|
| | Frame No. | | | | Average |
| Data No. | 0 | 1 | 2 | 3 | value |
| 0 | a | a | a | a | a |
| 1 | b | a | a | a | a + 0.25 |
| 2 | a | b | a | b | a + 0.5 |
| 3 | a | b | b | b | a + 0.75 |

In the time series operation processing discussed above, the number of scales is increased by increasing the number of frames per time series information pattern. In the example given above, four frames are considered one screen, in which case continuous-tone image display is enabled having the number of scales about four times that of display where one frame is one screen.

However, since gradation is represented using a number of frames as an image of one unit in the image processing method by the conventional time series operation processing described above, the number of frames of one unit needs to be much increased to increase the number of scales, leading to degradation of the actual frame rate (the number of frames per unit time) and causing images to flicker.

For example, normally 60 frames are displayed a second on an LCD. If the number of frames of one unit in time series operation processing is 16 as an example, the number of scales is remarkably increased to improve the continuous-tone image display capability, but repetitions of about three periods a second are made as an image. In such a degree, the image is recognized as flickering that can be noted by human's eyes.

For this reason, formerly only two to four frames were able to be provided for the number of frames of one time series information pattern unit; therefore, the continuous-tone image display capability was only able to be improved by two to four times at most. It is difficult to make a displayed image approach to the source image.

Also in the aspect of the circuit configuration, a complicated circuit for generating time series information patterns needs to be provided; it is difficult to implement such a circuit configuration.

SUMMARY OF THE INVENTION

Accordingly, it is an object of the invention to provide an image information processor which can provide image display near to a source image by making pseudo continuous-tone image display by pseudo representations.

To the end, according to one embodiment of the invention, there is provided an image information processor, when it is assumed that P and L are natural numbers of 2 or greater, which generates L-bit image display data based on P-bit source image data, L being less than P, the image information processor comprising addition means, when it is assumed that N is a natural number of 2 or greater, for adding error data of a picture element of the (N−1)st frame to the corresponding picture element data of the Nth frame, information selection means for outputting high-order L bits of P-bit data provided by the addition means as image display data of the Nth frame and at least one bit of the remaining (P−L) bits as error data of the picture element of the Nth frame, and means for storing the error data. Thus, addition of the error data of a picture element of one frame to the same picture element of the next frame lessens the brightness difference between both the picture elements and smooths a time change in brightness, enabling image display to approach to the source image.

According to another embodiment of the invention, there is provided an image information processor, when it is assumed that P and L are natural numbers of 2 or greater, which generates L-bit image display data based on P-bit source image data, L being less than P, the image information processor comprising processing means for generating (L+1)-bit image display data from the P-bit source image data, means for generating a control signal in response to predetermined information, and information generation means being responsive to the control signal for executing or suppressing addition of the least significant bit of the (L+1)-bit image display data and at least high-order bits of the (L+1)-bit image display data and generating L-bit image display data. If the predetermined information is, for example, frame information, addition is executed and suppressed alternately for each frame. If the least significant bit of the (L+1)-bit image data is "1," "1" and "0" are added to the L-bit image data alternately for each frame for error diffusion between frames. On the other hand, when the least significant bit of the (L+1)-bit image data is "0," even if addition is executed and suppressed alternately, the image data does not change. Even a motion image is assumed to be a still image between contiguous frames and image data is considered to be equal between frames and addition of the least significant bit of the (L+1)-bit image data to the L-bit image data as error data is executed and suppressed alternately for each frame, thereby realizing error diffusion between frames.

According to a further embodiment of the invention, there is provided an image information processor, when it is assumed that P and L are natural numbers of 2 or greater, which generates L-bit image display data based on P-bit source image data, L being less than P, the image information processor comprising means for calculating the difference between first and second source image data pieces in a frame, comparison means for determining whether or not the difference exceeds a predetermined value, information generation means, if the difference does not exceed the predetermined value, for adding a first error data piece which is an error between the first source image data and a first image display data corresponding to a first picture element to the second source image data corresponding to a second picture element contiguous to the first picture element, and if the difference exceeds the predetermined value, for suppressing the addition, and information selection means for outputting high-order L bits of P-bit data output from the information generation means as image display data of the second picture element and at least one bit of the remaining (P−L) bits as a second error data piece. At an edge of an image which changes sharply, the difference between the source image data pieces of the two picture elements with the edge between is large, thus addition of error data to the contiguous picture element is not executed. This can prevent the edges of the image from blurring when the brightness difference lessens between the two picture elements with the edge between.

According to another embodiment of the invention, there is provided an image information processor, when it is assumed that P and L are natural numbers of 2 or greater, which generates L-bit image display data based on P-bit source image data, L being less than P, the image information processor comprising first operational means for adding internal image process data and source image data to generate (P−L)-bit error data and L-bit image display data for outputting, first storage means for holding the (P−L)-bit error data for the period of one line for outputting as error data of picture element of the immediately preceding line, second storage means for holding the (P−L)-bit error data for the period of one picture element for outputting as error data of the immediately preceding picture element, and second operational means for outputting to the first operational means the internal image process data which is high-order (P−L) bits of (P−L+1)-bit data provided by adding the (P−L)-bit error data of the picture element of the immediately preceding line and the (P−L)-bit error data of the immediately preceding picture element.

According to a further embodiment of the invention, there is provided an image information processor, when it is assumed that P, L, and Q are natural numbers of 2 or greater, which generates L-bit image display data based on P-bit source image data, L being less than P, the image information processor comprising inframe processing means for processing the P-bit source image data in a frame and generating Q-bit internal image process data, Q being less than P, and interframe processing means for processing the internal image process data among a plurality of frames and generating the L-bit image display data. Locating a plurality of interframe processing means enables the image information processor to be applied to a plurality of different LCD drivers.

DESCRIPTION OF THE PREFERRED EMBODIMENTS

[First embodiment]

Referring now to the accompanying drawings, there is shown an image information processor according to a first embodiment of the invention.

The image information processor according to the first embodiment of the invention is located between an output section which outputs source image data (not shown) and an LCD driver which drives an LCD. The image information processor compresses 6-bit source image data into 3-bit image display data and outputs it to the LCD driver which inputs 3-bit data.

In such a case, the low-order three bits of the six bits of the source image data are discarded, and only the high-order three bits are used as image display data. Only eight scales ($2^3$) would be able to be obtained without taking any additional measures. Thus, it is necessary to perform pseudo gradation processing for making a display image approach to the source image by pseudo representations.

Figure 1:
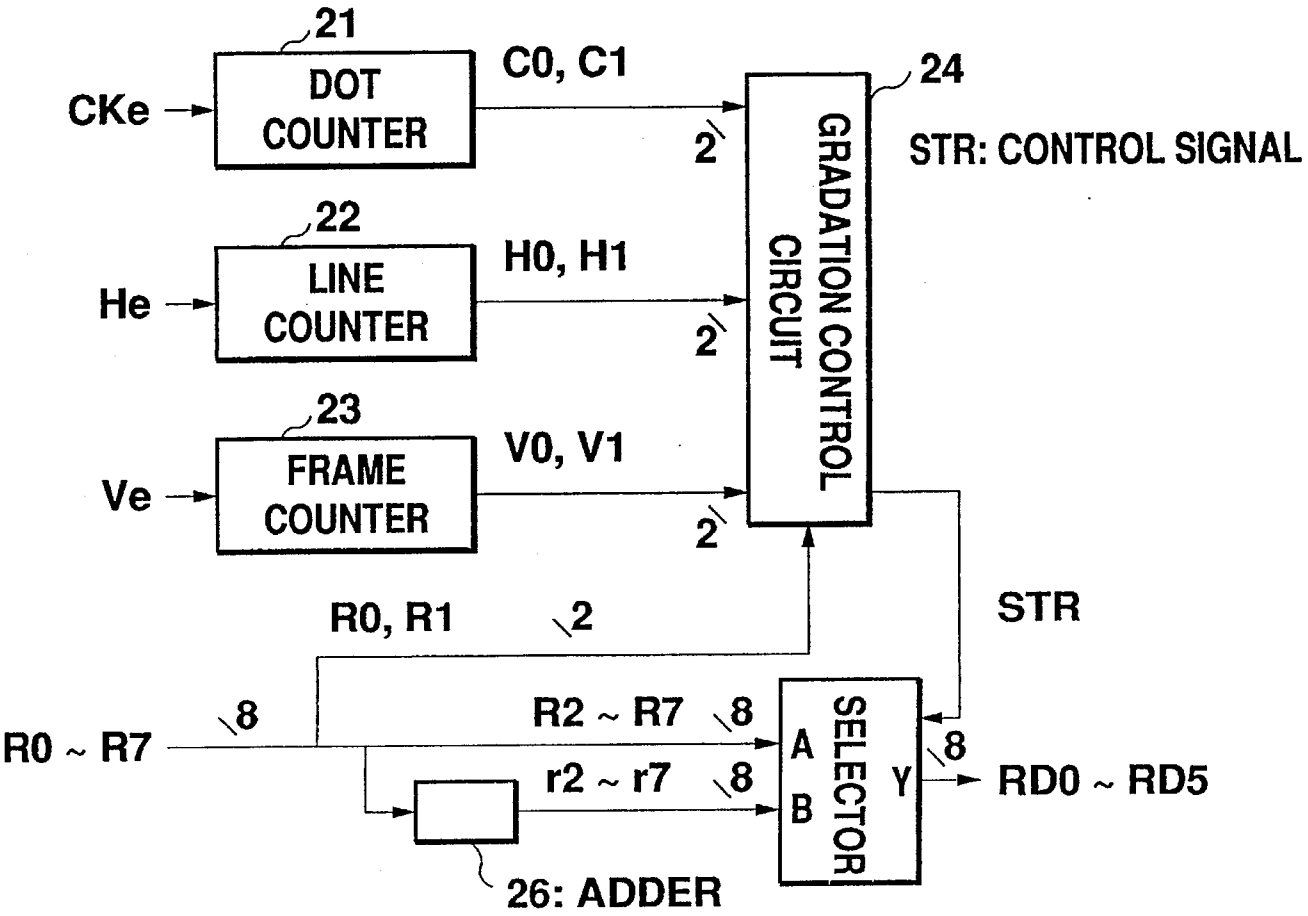
Fig. 1 RELATED ART
FIG. 1 is a block diagram of an image information processor in the related art.
Figure 2:
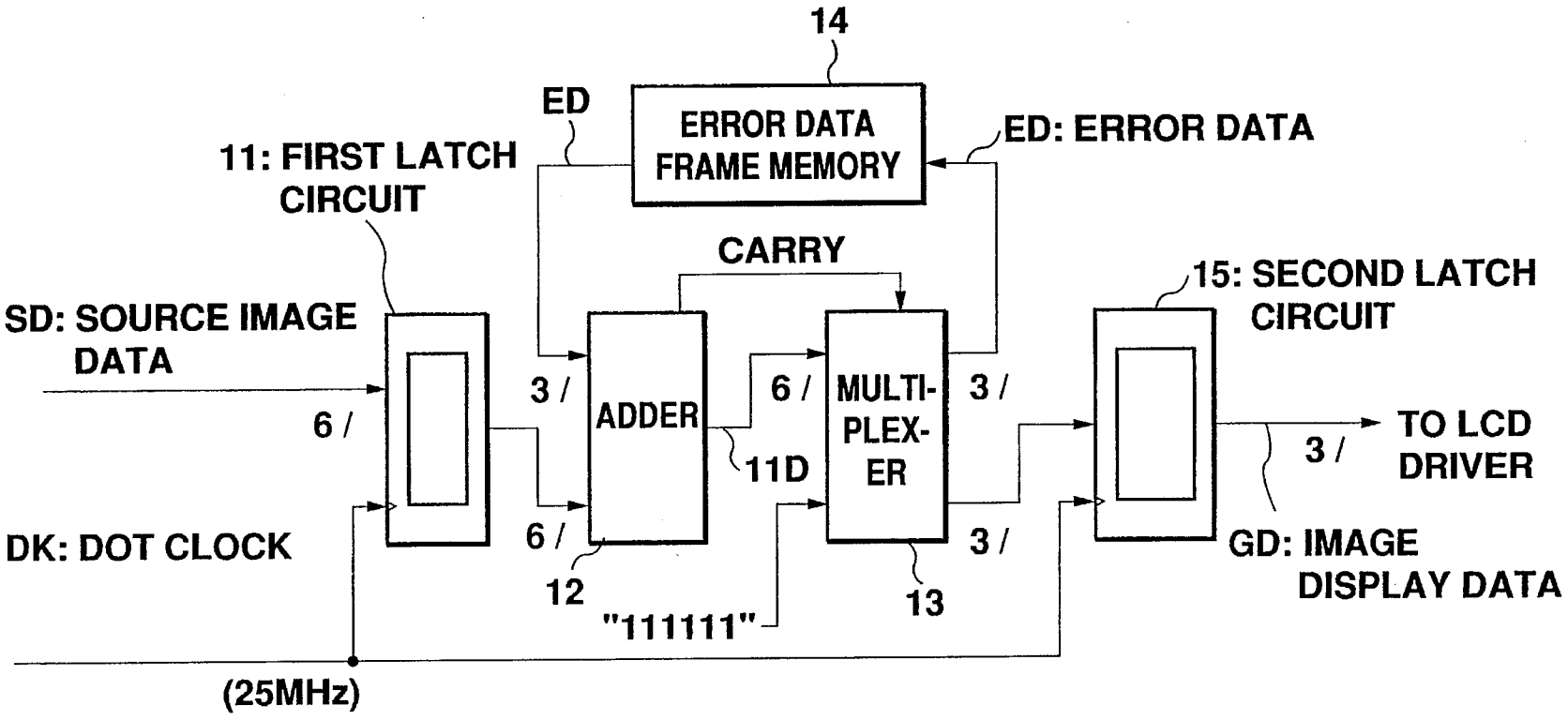
FIG. 2 is a block diagram of an image information processor according to a first embodiment of the invention.

The image information processor according to the first embodiment of the invention comprises a first latch circuit 11, an adder 12, a multiplexer 13, an error data frame memory 14, and a second latch circuit 15, as shown in FIG. 2.

The first latch circuit 11 is a circuit for once holding 6-bit input source image data (SD) of each frame and outputting the data to the adder 12 in response to a dot clock (DK). Description is given here only for data of red because similar processing for blue and green is performed concurrently by similar processors.

The adder 12 adds the source image data (SD) and 3-bit error data (ED) read from the error data frame memory 14 and outputs the resultant 6-bit correction image data (HD).

The multiplexer 13 divides the correction image data (HD) input from the adder 12 into the high-order three bits and the low-order three bits and outputs image display data (GD), the high-order three bits of the correction image data (HD), to the second latch circuit 15 and writes error data (ED), the low-order three bits, into the error data frame memory 14.

The error data frame memory 14 is a memory where the error data (ED), the low-order three bits of the correction image data (HD), is written/read; it holds the error data (ED) for each frame for the 1-frame period.

The second latch circuit 15 is a circuit for once holding the image display data (GD) input from the multiplexer 13 and outputting it to an external LCD driver (not shown) in response to a dot clock (DK).

In operation, first the Nth source image data (SD2), which is 6-bit data, corresponding to the Nth frame to be processed (N is a natural number of 2 or greater) is input to the first latch circuit 11 which then outputs the data (SD2) to the adder 12 in synchronization with a dot clock (DK).

Next, the adder 12 adds the [N−1]st error data (ED1) found on the frame immediately preceding the Nth frame, namely, the [N−1]st frame and the Nth source image data (SD2) to generate the Nth correction image data (HD2) corresponding to the Nth frame, which is 6-bit data.

Next, the Nth correction image data (HD2) is output to the multiplexer 13 which then divides the data (HD2) into the high-order three bits and the low-order three bits. The high-order 3-bit data is output to the second latch circuit 15 as data for image display of picture element of the Nth frame (hereinafter, referred to as the Nth image display data (GD2)). The low-order 3-bit data is output to the error data frame memory 14 as the Nth error data (ED2) corresponding to the Nth frame, and is held in place of the [N−1]st error data (ED1).

It is inconvenient to output data "000000" from the adder 12 as a result of a carry by the addition by the adder 12, in which case 6-bit data "111111" is output from the multiplexer 13 in response to the carry signal output from the adder 12.

Next, the Nth image display data (GD2) is output to the external LCD driver (not shown) from the second latch circuit 15 in response to a dot clock. By repeating these steps in sequence, the [N−1]st error data (ED1) is added to the Nth source image data (SD2) in sequence.

As described above, with the image information processor according to the first embodiment of the invention, the adder 12 adds the 6-bit Nth source image data (SD2) and the 3-bit [N−1]st error data (ED1), and the multiplexer 13 outputs the high-order three bits of the 6-bit Nth correction image data (HD2), the addition result, to the second latch circuit as the Nth image display data (GD2) and outputs the remaining low-order 3-bit data to the error data frame memory as the Nth error data (ED2). The error data frame memory 14 performs read/write processing for error data (ED1, ED2).

Thus, it is made possible to add error data to each picture element of the next frame in sequence, and a complicated circuit for generating time series information patterns as in the conventional time series operation processing in which a number of frames are regarded as one screen is not required; therefore, the circuit configuration can be made very simple in the embodiment.

An image information processing method according to the first embodiment of the invention is described with reference to a flowchart in FIG. 3.

First, at step P1 in the flowchart, the high-order three bits of the first source image data which is 6-bit data corresponding to a picture element of the first frame are taken as the first image display data corresponding to the picture element of the first frame, and the low-order three bits of the first source image data are held as the first error data corresponding to the first frame.

At the time, the first source image data is input via the first latch circuit 11 to the adder 12, and is output to the multiplexer 13 intact which then divides the first source image data into the high-order three bits and the low-order three bits. The high-order three bits are output to the LCD driver (not shown) as the first image display data, and the low-order three bits are written out into the error data frame memory 14 as the first error data.

Next, at step P2, initial value 2 is set in N (N=2).

Next, at step P3, the [N−1]st error data (ED1) corresponding to the [N−1]st frame (N is a natural number of 2 or greater) is added to the Nth source image data (SD2) to generate the Nth correction image data (HD2).

Since N=2 is set at step P2, the "[N−1]st frame" becomes the first frame and the "Nth frame" becomes the second frame at the beginning.

At the time, the Nth source image data (SD2) is input via the first latch circuit 11 to the adder 12. On the other hand, the [N−1]st error data (ED1) is read from the error data frame memory 14 into the adder 12. The adder 12 adds the Nth source image data (SD2) and the [N−1]st error data (ED1) to generate the Nth correction image data (HD2) and outputs the data (HD2) to the multiplexer 13.

Next, at step P4, the high-order three bits of the Nth correction image data (HD2) are used as the Nth image display data (GD2) and the low-order three bits of the Nth correction image data (HD2) are held as the Nth error data (ED2) corresponding to the Nth frame.

At the time, the multiplexer 13 divides the Nth correction image data (HD2) into the high-order three bits and the low-order three bits. The high-order three bits are output to the LCD driver (not shown) as the Nth image display data (GD2), and the low-order three bits are written out into the error data frame memory 14 as the Nth error data (ED2).

Next, at step P5, whether or not processing of the picture elements of the Nth frame is complete is determined. Upon completion (Yes), control advances to step P6; upon incompletion (No), control returns to step P3 for repeating the steps P3 and P4.

Next, at step P6, 1 is added to N. For example, if N equals 2 at the time, N is set to 3 after 1 is added.

Next, at step P7, termination is confirmed. If the processing may be terminated (Yes), it is terminated. To continue the processing (No), control returns to step P3 and the steps are repeated. By repeating the sequence, the steps P3 and P4 are repeated for N=3, 4, 5, . . . , thereby processing a large number of frames in the order of the third frame, fourth frame, and so forth on.

Figure 3:
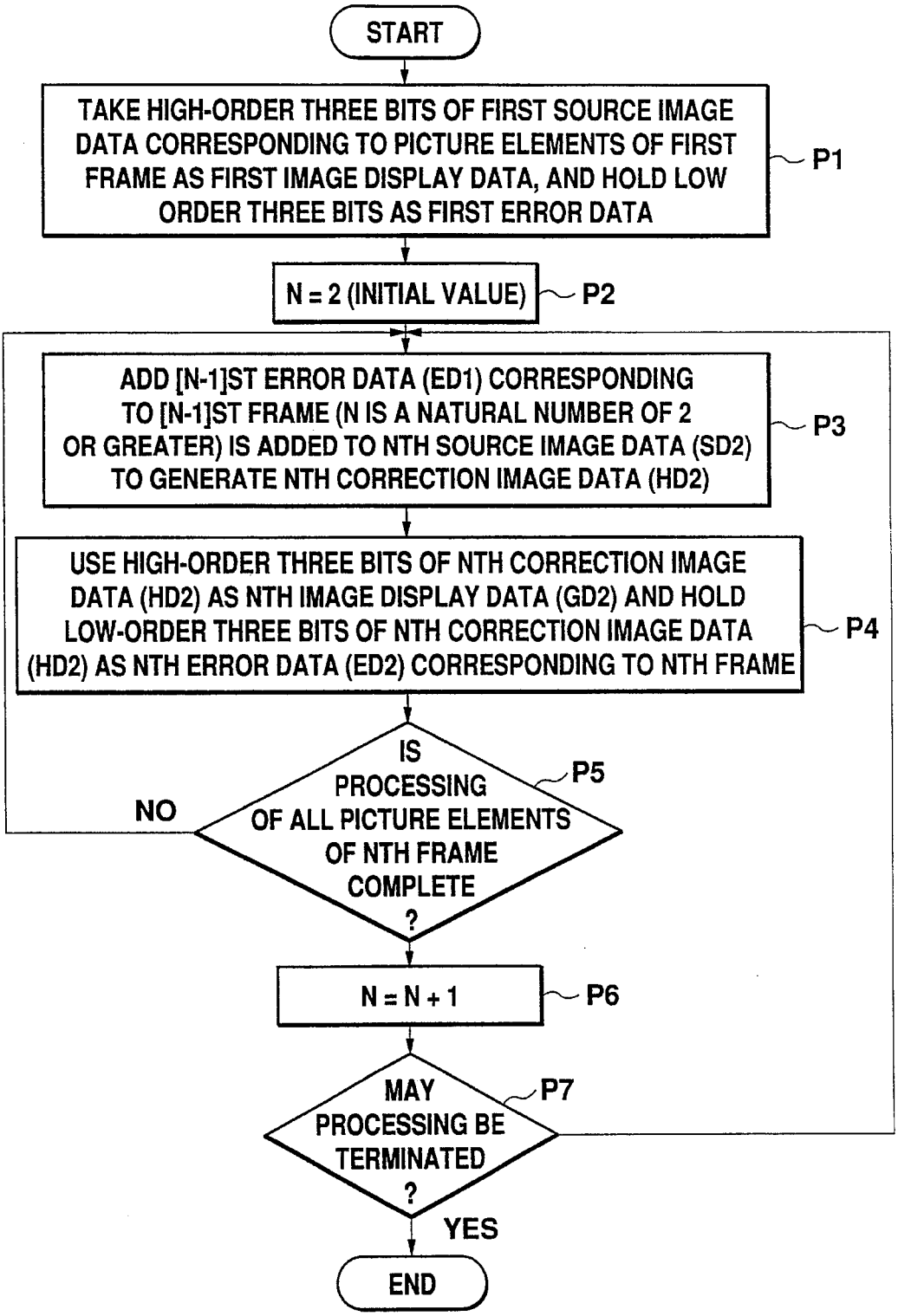
FIG. 3 is a flowchart for describing an image information processing method according to the first embodiment of the invention.

As described above, according to the invention, the [N−1]st error data (ED1) is added to the Nth source image data (SD2) as shown at step P3 in the flowchart of FIG. 3.

Thus, addition of error data to each picture element of the next frame in sequence lessens the brightness difference between one picture element of one frame and the corresponding picture element of the immediately preceding frame for even display as a whole, thereby preventing so-called pseudo contour, etc., and enabling image display to approach to the source image much more.

Flickering caused by switching screens for each time series information pattern as in the conventional time series operation processing can also be inhibited.

Although 6-bit source image data is compressed into three bits for output in the embodiment, 8-bit source image data can also be compressed into three or six bits for output as well.

For example, to compress 8-bit source image data into three bits, error data becomes five bits, thus the number of bits of the error data to be added increases, enabling improvement in the continuous-tone image display capability much more.

In the embodiment, the adder 12 as addition means, the multiplexer 13 as information selection means, and the error data frame memory 14 as storage means are used, but the configuration of the invention is not limited to them.

[Second embodiment]

Figure 4:
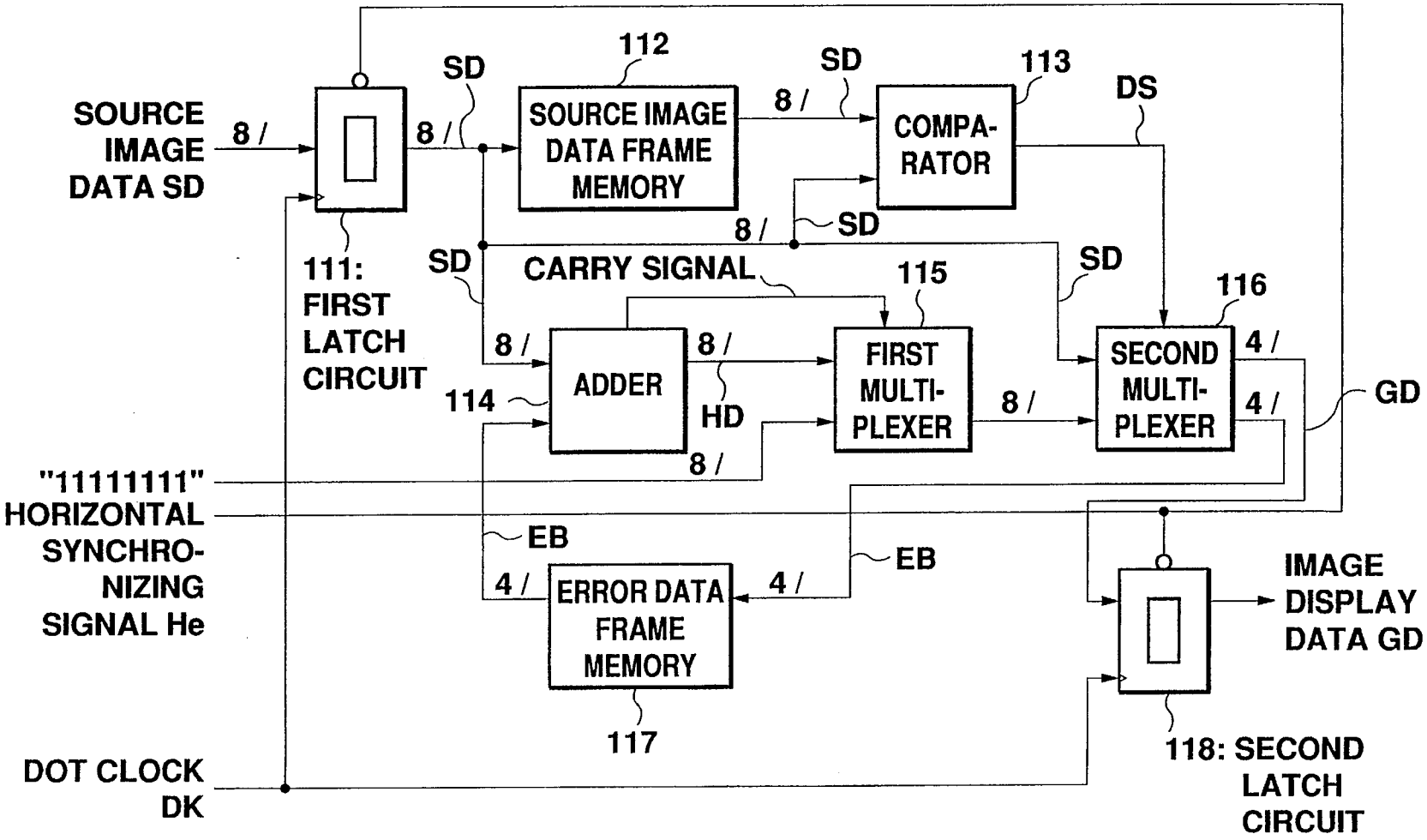
FIG. 4 is a block diagram of an image information processor according to a second embodiment of the invention.

Referring now to FIG. 4, there is shown an image information processor according to a second embodiment of the invention.

The image information processor according to the second embodiment of the invention is located between an output section which outputs source image data (not shown) and an LCD driver which drives an LCD. The image information processor compresses 8-bit source image data into 4-bit image display data and outputs it to the LCD driver which inputs 4-bit data.

In such a case, the low-order four bits of the eight bits of the source image data are discarded, and only the high-order four bits are used as image display data. Only 16 scales ($2^4$) would be able to be obtained without taking any additional measures. Thus, it is necessary to perform pseudo gradation processing for making a display image approach to the source image by pseudo representations. Description is given here only for data of red because similar processing for blue and green is performed concurrently by similar processors.

The image information processor according to the second embodiment of the invention comprises a first latch circuit 111, a source image data frame memory 112, a comparator 113, an adder 114, a first multiplexer 115, a second multiplexer 116, an error data frame memory 117, and a second latch circuit 118, as shown in FIG. 4. In the description to follow, the nth picture element of the Nth frame is referred to as the "[N, n]th picture element."

The first latch circuit 111 is a circuit for once holding 8-bit input source image data (SD) of each picture element and outputting the data to the source image data frame memory 112, the comparator 113, and the adder 114 in response to a dot clock (DK).

The source image data frame memory 112 is a circuit, for example, when the [N, n]th picture element is processed, for holding the source image data (SD) of the [N−1, n]th picture element for the period of one picture element in order to compare the source image data (SD) of the [N, n]th picture element with the source image data (SD) of the [N−1, n]th picture element and outputting the source image data (SD) of the [N−1, n]th picture element to the comparator 113.

The comparator 113 calculates the difference between the source image data (SD) of the [N−1, n]th picture element output from the source image data frame memory 112 and the source image data (SD) of the [N, n]th picture element, and if the difference exceeds a preset threshold, outputs a drive control signal (DS) to the second multiplexer 116.

The adder 114 adds 4-bit interframe error data (EB) read from the error data frame memory 117 and the 8-bit source image data (SD) output from the first latch circuit 111 to generate 8-bit correction image data (HD) and outputs the data (HD) to the first multiplexer 115. The first multiplexer 115 outputs the 8-bit correction image data (HD) to the second multiplexer 116.

The second multiplexer 116 generates 4-bit interframe error data (EB) and 4-bit image display data (GD) based on either of the 8-bit correction image data (HD) input from the first multiplexer 115 and the 8-bit source image data (SD) input from the first latch circuit 111 in response to the drive control signal (DS) output from the comparator 113, and outputs the data EB and GD to the error data frame memory 117 and the second latch circuit 118 respectively.

The error data frame memory 117 holds the interframe error data (EB) for the 1-frame period for outputting to the adder 114.

The second latch circuit 118 outputs the image display data (GD) to the LCD driver (not shown) in response to a dot clock (DK).

As described above, the image information processor according to the second embodiment comprises the adder 114, the second multiplexer 116, the source image data frame memory 112, and the comparator 113.

For example, when the [N, n]th picture element is processed, the source image data (SD) of the [N−1, n]th picture element is temporarily held in the source image data frame memory 112, then output to the comparator 113, and the interframe error data (EB) of the [N−1, n]th picture element is added to the source image data (SD) of the [N, n]th picture element by the adder 114 to generate the 8-bit correction image data (HD) of the [N, n]th picture element, then the data HD is output to the second multiplexer 116. The difference between the source image data (SD) of the [N−1, n]th picture element and the source image data (SD) of the [N, n]th picture element is calculated by the comparator 113, and if the difference exceeds a predetermined value, a drive control signal (DS) is output to the second multiplexer 116; if the difference does not exceed the predetermined value, the drive control signal (DS) is not output. When the drive control signal (DS) is input to the second multiplexer 116, error diffusion between frames is not made; the high-order four bits of the source image data (SD) of the [N, n]th picture element are used as the image display data (GD) of the [N, n]th picture element and the low-order four bits are used as the interframe error data (EB) of the [N, n]th picture element. When the drive control signal (DS) is not input, the high-order four bits of the correction image data (HD) of the [N, n]th picture element resulting from error diffusion are used as the image display data (GD) of the [N, n]th picture element and the low-order four bits are used as the interframe error data (EB) of the [N, n]th picture element.

Thus, proper setting of the predetermined value makes it possible to suppress addition of the source image data (SD) and the interframe error data (EB) of contiguous picture elements in a portion where the image changes sharply; the image information processing method according to the second embodiment of the invention can be realized.

Between two frames at the time an image changes sharply, the source image data difference between two picture elements of the frames is large, thus addition of error data to the same picture elements of the contiguous frames is not executed.

This can prevent a residual image from occurring and an image from instantaneously blurring when the picture element brightness difference between two frames lessens at the time an image changes sharply; particularly in animation, a nearer image to the source image can be displayed.

In the embodiment, the source image data frame memory 112 is used as an example of storage means, the comparator 113 as an example of comparison means, the adder 114 as an example of addition means, and the second multiplexer 116 as an example of information generation means, but the configuration of the invention is not limited to them.

In the embodiment, the processor of 8-bit input, 4-bit output is described, but the embodiment is also applicable to a processor of 8-bit input, 3-bit output, the processor of 6-bit input, 3-bit output shown in the conventional example, and so forth.

[Third embodiment]

Figure 5:
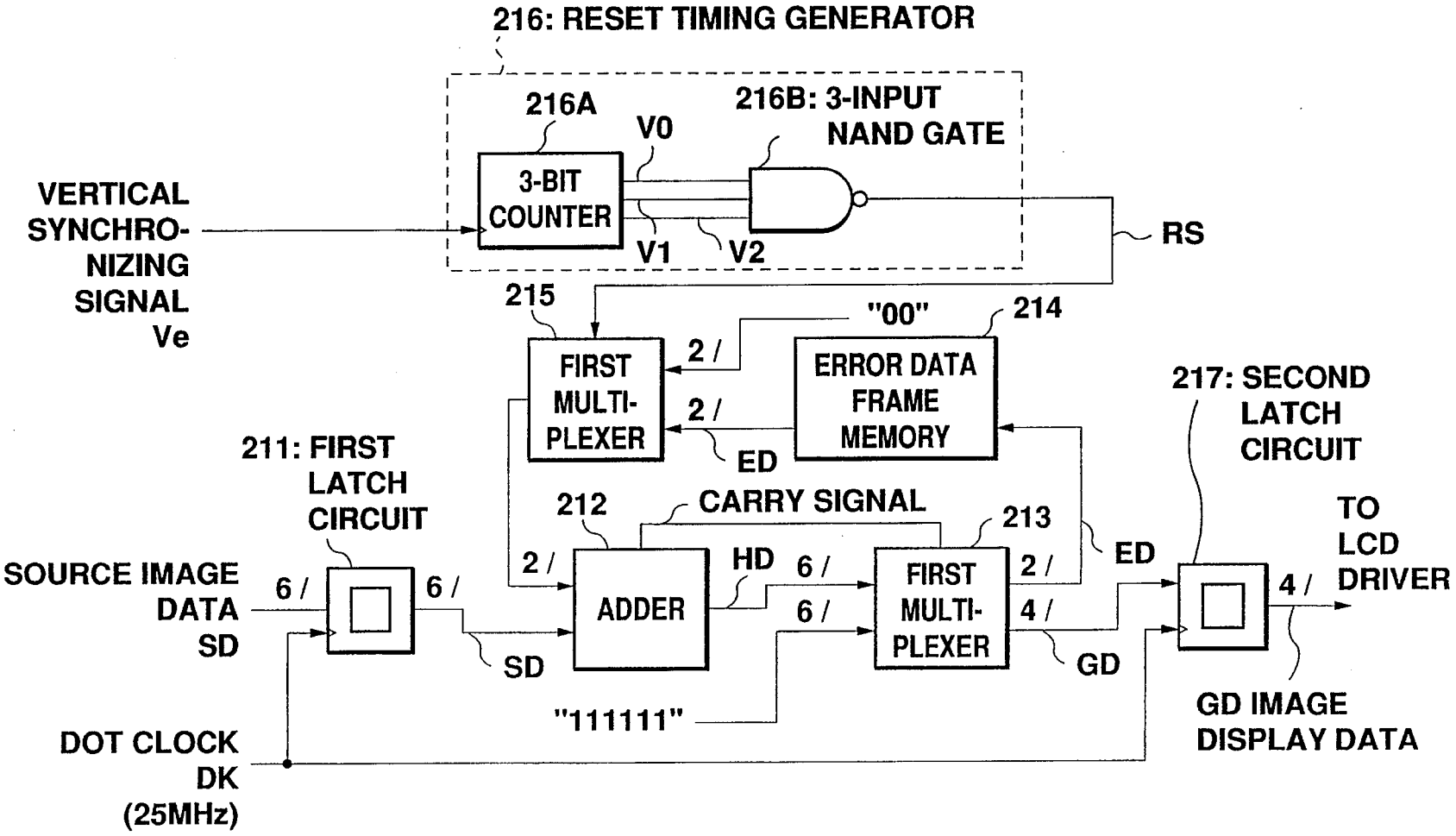
FIG. 5 is a block diagram of an image information processor according to a third embodiment of the invention.
Figure 6:
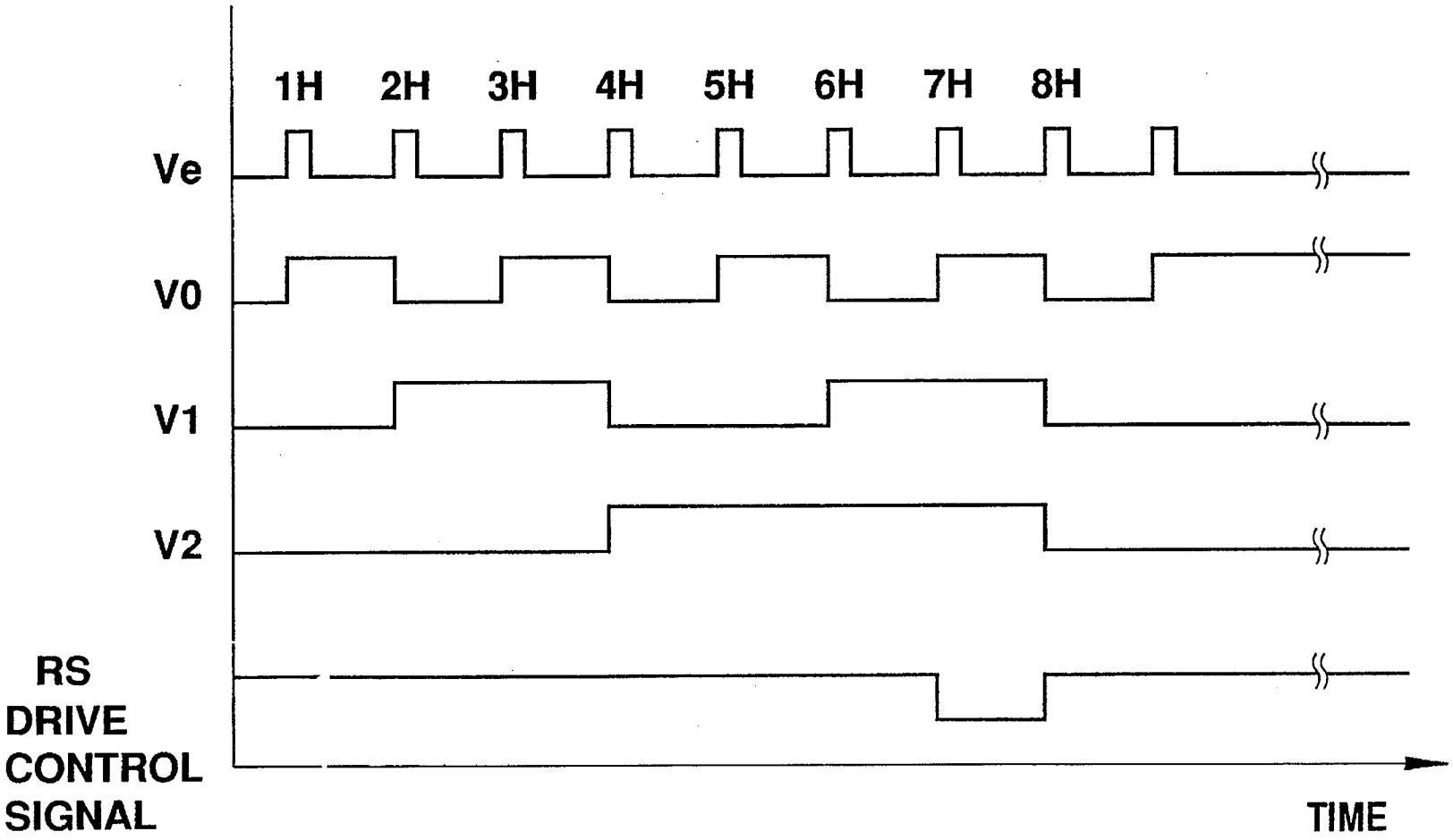
FIG. 6 is a timing chart for describing the image information processing method according to the third embodiment of the invention.

Referring now to FIGS. 5 to 6, there is shown an image information processor according to a third embodiment of the invention.

The image information processor according to the third embodiment of the invention is located between an output section which outputs source image data (not shown) and an LCD driver which drives an LCD. The image information processor compresses 6-bit source image data into 4-bit image display data and outputs it to the LCD driver which inputs 4-bit data.

In such a case, the low-order two bits of the six bits of the source image data are discarded, and only the high-order four bits are used as image display data. Only 16 scales ($2^4$) would be able to be obtained without taking any additional measures. Thus, it is necessary to perform pseudo gradation processing for making a display image approach to the source image by pseudo representations. Description is given here only for data of red because similar processing for blue and green is performed concurrently by similar processors.

The image information processor according to the third embodiment of the invention comprises a first latch circuit 211, an adder 212, a first multiplexer 213, an error data frame memory 214, a second multiplexer 215, a reset timing generator 216, and a second latch circuit 217, as shown in FIG. 5.

The first latch circuit 211 is a circuit for once holding 6-bit input source image data (SD) of each frame and outputting the data to the adder 212 in response to a dot clock (DK).

The adder 212 adds the source image data (SD) and 2-bit error data (ED) output from the second multiplexer 215 and outputs the resultant 6-bit correction image data (HD).

The first multiplexer 213 divides the correction image data (HD) input from the adder 212 into the high-order four bits and the low-order two bits and outputs image display data (GD), the high-order four bits of the correction image data (HD), to the second latch circuit 215 and writes error data (ED), the low-order two bits, into the error data frame memory 214.

The error data frame memory 214 is a memory where the error data (ED), the low-order two bits of the correction image data (HD), is written/read; it holds the error data (ED) for each frame for the 1-frame period for output to the second multiplexer 215.

The second multiplexer 215 selectively outputs either of the error data (ED) read from the error data frame memory 214 and 2-bit data "00" to the adder 212 in response to a drive control signal (RS) output from the reset timing generator 216.

The reset timing generator 216, which consists of a 3-bit counter 216A and a 3-input NAND gate 216B, generates a drive control signal (RS) for driving the second multiplexer 215 in response to a vertical synchronizing signal Ve.

The 3-bit counter 216A divides the vertical synchronizing signal Ve by 2, 4, and 8 to generate signals V0, V1, and V2 respectively, and outputs the signals to the 3-input NAND gate 216B.

The 3-input NAND gate 216B inputs the signals V0, V1, and V2 and ANDs them, and if all the signals V0, V1, and V2 are high, outputs a drive control signal (RS) which is low to the second multiplexer 215; otherwise, outputs a high level. The drive control signal (RS) is output low once every eight frames as described below, at the time of which "00" is output from the second multiplexer 215, thus apparently the error data (ED) becomes "00".

The second latch circuit 217 is a circuit for once holding the image display data (GD) input from the first multiplexer 213 and outputting it to an external LCD driver (not shown) in response to a dot clock (DK).

As described above, the image information processor according to the third embodiment comprises the adder 212, the first multiplexer 213, the error data frame memory 214, and the reset timing generator 216, as shown in FIG. 5.

For example, the adder 212 adds the source image data (SD) of a picture element of the Nth frame and the error data (ED) corresponding to the picture element of the (N−1)st frame at the same position as the picture element of the Nth frame. The first multiplexer 213 outputs the high-order four bits of the 6-bit data resulting from the addition as image display data (GD) and the remaining 2-bit data as error data (ED) of the Nth frame. The reset timing generator 216 clears the error data (ED) every eight frames.

The error data (ED) increasing gradually as frames are overlaid is reset to "00" every eight frames. Thus, the error data (ED) is not accumulated any more and does not increase either; the error data (ED) can affect the display image of each frame only within the range of eight frames.

FIG. 6 is a timing chart for describing the image information processing method according to the third embodiment.

In the timing chart, Ve is a vertical synchronizing signal, and V0, V1, and V2 are signals provided by dividing Ve by 2, 4, and 8 respectively. The signals V0, V1, and V2 are generated by the 3-bit counter 216A.

RS is a drive control signal which is an output signal of the 3-input NAND gate 216B to which the signals V0, V1, and V2 are input.

When all of the signals V0, V1, and V2 are high, the drive control signal RS is low; otherwise, high. In the frame when the drive control signal RS is low, the second multiplexer 215 selectively outputs 2-bit data "00" instead of error data (ED), thus the error data (ED) at the time is reset to "00" apparently.

Figure 8:
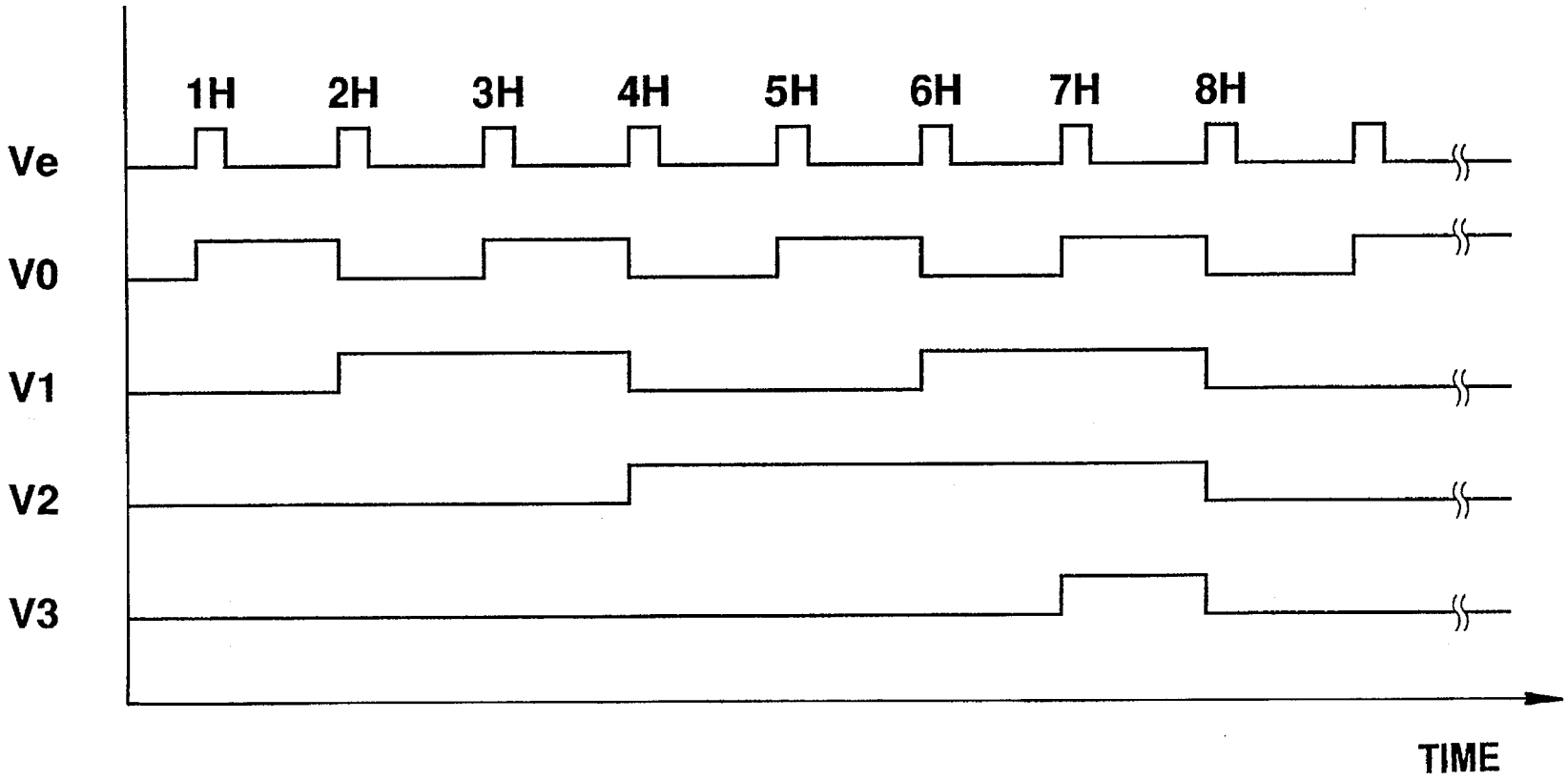
FIG. 8 is a timing chart for describing operation of a reset timing generator according to the fourth embodiment of the invention.

Since the drive control signal RS goes low once every eight frames as shown in FIG. 8, the error data (ED) is reset to "00" once every eight frames in the embodiment. Here, the 3-bit counter 216A is used, thus the error data (ED) is reset to "00" once every $2^3=8$ frames. If a 2-bit counter is used, the error data (ED) can be reset to "00" once every $2^2=4$ frames; if a 4-bit counter is used, the data can be reset once every $2^4=16$ frames.

Resetting of the error data (ED) to "00" every eight frames prevents the error data (ED) in fairly previous frames from adversely affecting the display image of the current frame being processed. The error data (ED) related to an irrelevant image in fairly previous frames does not affect the display image, leading to prevention of flickering, etc.

Also, a still image can be followed accurately by resetting the error data (ED) to "00" every eight frames.

Since the source image data (SD) does not change to display a still image, for example, if source image data (SD) is "XXX001", the error data (ED) always becomes "01". As it is added in sequence, the correction image data (HD) and image display data (GD) in each frame become as listed in Table 3.

TABLE 3

| | Correction image data (HD) | Image display data (GD) |
|---|---|---|
| 1 frame | "xxx001" | "xxx0" |
| 2 frame | "xxx010" | "xxx0" |
| 3 frame | "xxx011" | "xxx0" |
| 4 frame | "xxx100" | "xxx1" |

As listed above, when the error data (ED) becomes "01", a carry occurs on the least significant bit (LSB) of the image display data (GD) due to the error data (ED) once every four frames, and the effect of interframe error diffusion appears. If the error data (ED) is greater than "10", a carry occurs on the image display data (GD) every a fewer number of frames than four.

If the error data (ED) is reset to "00" every less than four frames, in the instance given above, the error data (ED) is reset to "00" before a carry occurs on the image display data (GD) due to the error data (ED), thus the effect of interframe error diffusion does not appear. Therefore, if the error data consists of two bits for a still image, the interval at which the error data (ED) is reset to "00" must be a minimum of $2^2=4$ frames.

Likewise, the interval at which the error data (ED) is reset must be a minimum of $2^3=8$ frames when the error data is three bits; a minimum of $2^4=16$ frames when the error data is four bits; . . . ; a minimum of $2^n$ frames when the error data is n bits.

In the embodiment, the error data is two bits and is reset to "00" once every eight frames, the number of which is an integer multiple of four and satisfies the minimum requirement.

Therefore, if the error data (ED) is n bits, the error data (ED) is reset to "00" once every as many frames as an integer multiple of $2^n$, thereby covering even a still image without losing the effect of interframe error diffusion.

In the embodiment, the adder 212 is used as an example of addition means, the first multiplexer 213 as an example of information operation means, the error data frame memory 214 as an example of storage means, and the second multiplexer 215 as an example of information clear means, but the configuration of the invention is not limited to them.

In the embodiment, the processor of 6-bit input, 4-bit output is described, but the embodiment is also applicable to a processor of 8-bit input, 3-bit output, a processor of 6-bit input, 3-bit output, and so forth.

[Fourth embodiment]

Figure 7:
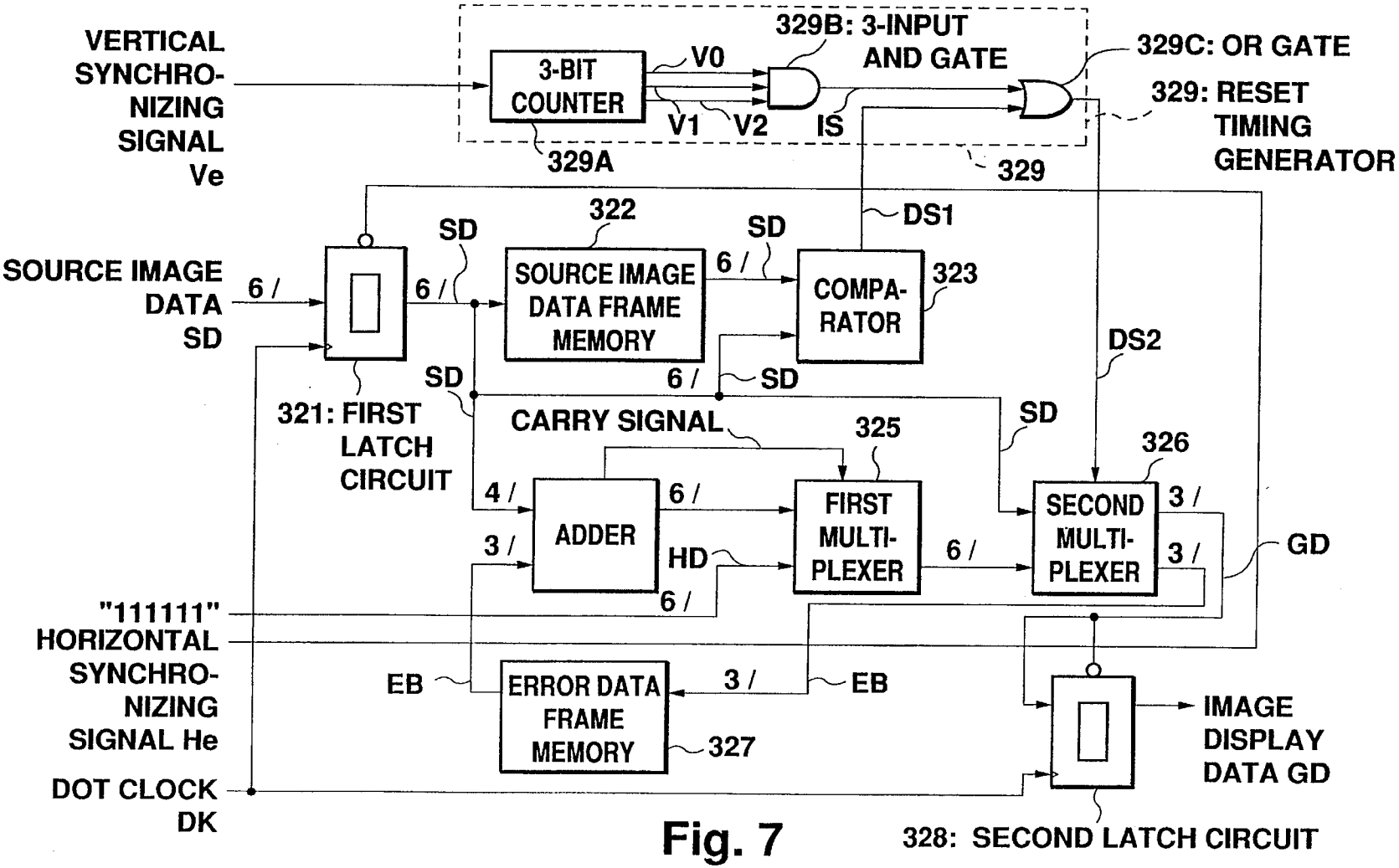
FIG. 7 is a block diagram of an image information processor according to a fourth embodiment of the invention.

Referring now to FIGS. 7 to 8, there is shown an image information processor according to a fourth embodiment of the invention.

The image information processor according to the fourth embodiment of the invention is located between an output section which outputs source image data (not shown) and an LCD driver which drives an LCD. The image information processor compresses 6-bit source image data into 3-bit image display data and outputs it to the LCD driver which inputs 3-bit data.

In such a case, the low-order three bits of the six bits of the source image data are discarded, and only the high-order three bits are used as image display data. Only eight scales ($2^3$) would be able to be obtained without taking any additional measures. Thus, it is necessary to perform pseudo gradation processing for making a display image approach to the source image by pseudo representations. Description is given here only for data of red because similar processing for blue and green is performed concurrently by similar processors.

The image information processor according to the fourth embodiment of the invention comprises a first latch circuit 321, a source image data frame memory 322, a comparator 323, an adder 324, a first multiplexer 325, a second multiplexer 326, an error data frame memory 327, a second latch circuit 328, and a reset timing generator as shown in FIG. 7. In the description to follow, the nth picture element of the Nth frame is referred to as the "[N, n]th picture element."

The first latch circuit 321 is a circuit for once holding 6-bit input source image data (SD) of each picture element and outputting the data to the source image data frame memory 322, the comparator 323, and the adder 324 in response to a dot clock (DK).

The source image data frame memory 322 is a circuit, for example, when the [N, n]th picture element is processed, for holding the source image data (SD) of the [N−1, n]th picture element in order to compare the source image data (SD) of the [N, n]th picture element with the source image data (SD) of the [N−1, n]th picture element and outputting the source image data (SD) of the [N−1, n]th picture element to the comparator 323.

The comparator 323 calculates the difference between the source image data (SD) of the [N−1, n]th picture element output from the source image data frame memory 322 and the source image data (SD) of the [N, n]th picture element, and if the difference exceeds a preset threshold, outputs a first drive control signal (DS1) to an OR gate 329C of the reset timing generator 329.

The adder 324 adds 3-bit interframe error data (EB) read from the error data frame memory 327 and the 6-bit source image data (SD) output from the first latch circuit 321 to generate 6-bit correction image data (HD) and outputs the data (HD) to the first multiplexer 325. The first multiplexer 325 outputs the 6-bit correction image data (HD) to the second multiplexer 326.

The second multiplexer 326 generates 3-bit interframe error data (EB) and 3-bit image display data (GD) based on either of the 6-bit correction image data (HD) input from the first multiplexer 325 and the 6-bit source image data (SD) input from the first latch circuit 321 in response to a second drive control signal (DS2) output from the OR gate 329C, and outputs the data EB and GD to the error data frame memory 327 and the second latch circuit 328 respectively.

The error data frame memory 327 holds the interframe error data (EB) for the 1-frame period for outputting to the adder 324.

The second latch circuit 328 outputs the image display data (GD) to the LCD driver (not shown) in response to a dot clock (DK).

The reset timing generator 329, which consists of a 3-bit counter 329A, a 3-input AND gate 329B, and the OR gate 329C, generates a second drive control signal (DS2) related to output control of the second multiplexer 326.

The 3-bit counter 329A divides the vertical synchronizing signal Ve by 2, 4, and 8 to generate signals V0, V1, and V2 respectively, and outputs the signals to the 3-input AND gate 329B.

The 3-input AND gate 329B ANDs the signals V0, V1, and V2 and outputs the ANDing result or an internal control signal (IS) to one input of the OR gate 329C.

The OR gate 329C ORs the first drive control signal (DS1) and the internal control signal (IS) and outputs the ORing result or a second drive control signal (DS2) to the second multiplexer.

Figure 12:
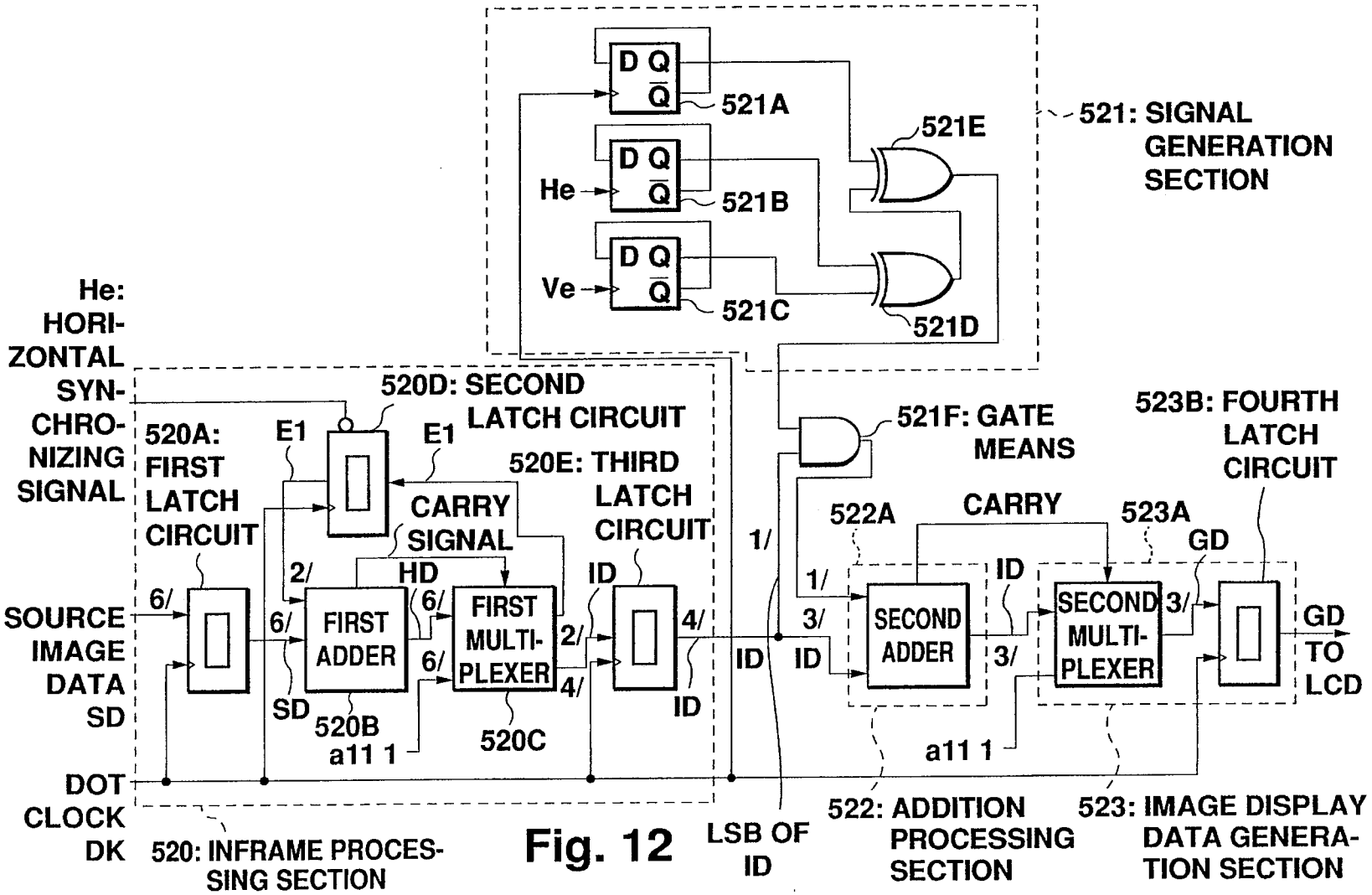
FIG. 12 is a block diagram of an image information processor according to a sixth embodiment of the invention.

As described above, the image information processor according to the fourth embodiment comprises the source image data frame memory 322, the adder 324, the comparator 323, the reset timing generator 329, and the second multiplexer 326, as shown in FIG. 12.

For example, the source image data (SD) of the [N, n]th picture element which is the nth picture element of the Nth frame is held for the 1-frame period in the source image data frame memory 322, then output to the comparator 323. The source image data (SD) of the [N, n]th picture element and the error data (EB) of the [N−1, n]th picture element are added to by the adder 324 to generate the correction image data of the [N, n]th picture element. The difference between the source image data (SD) of the [N, n]th picture element and the source image data (SD) of the [N−1, n]th picture element is calculated by the comparator 323, and if the difference exceeds a predetermined value, a first drive control signal (DS1) is output to the reset timing generator 329.

A second drive control signal (DS2) is output to the second multiplexer 326 every a given number of frames, for example, $a\times2^n$ frames by the reset timing generator 329 or when the first drive control signal (DS1) is input to the reset timing generator 329, a second drive control signal (DS2) is output to the second multiplexer. When the second drive control signal (DS2) is not input to the second multiplexer 326, the high-order three bits of the correction image data (HD) of the [N, n]th picture element are used as the image display data (GD) of the [N, n]th picture element and the remaining low-order 3-bit data is output to the adder 324 as the interframe error data (EB) of the [N, n]th picture element.

When the second drive control signal (DS2) is input to the second multiplexer 326, the high-order three bits of the source image data (SD) of the [N, n]th picture element are used as the image display data (GD) of the [N, n]th picture element and the remaining low-order 3-bit data is output to the adder 324 as the interframe error data (EB) of the [N, n]th picture element.

Thus, in processing at the time an image changes sharply in animation processing, etc., a first drive control signal (DS1) is output from the comparator 323 to the reset timing generator 329, and in response to the first drive control signal (DS1), a second drive control signal (DS2) is output from the reset timing generator 329 to the second multiplexer 326. Then, the second multiplexer 326 outputs the high-order three bits of the source image data intact as the image display data without error diffusion to the contiguous picture element.

Thus, proper setting of the given value makes it possible to suppress addition of the interframe error data (EB) to the same picture element of the contiguous frame in processing at the time the image changes sharply.

A second drive control signal (DS2) is output from the reset timing generator 329 to the second multiplexer 326 every a given number of frames, and in response to the signal, the interframe error data (EB) is cleared.

The interframe error data (EB) increasing gradually as frames are overlaid is cleared every a given number of frames. Thus, the interframe error data (EB) is not accumulated exceeding one given value and does not increase; the interframe error data (EB) can affect the display image of each frame only within the range of a given number of frames.

FIG. 8 is a timing chart for describing the image information processing method according to the fourth embodiment.

In the timing chart, Ve is a vertical synchronizing signal, and V0, V1, and V2 are signals provided by dividing Ve by 2, 4, and 8 respectively. The signals V0, V1, and V2 are generated by the 3-bit counter 329A.

IS is an internal control signal which is an output signal of the 3-input AND gate 329B to which the signals V0, V1, and V2 are input.

When all of the signals V0, V1, and V2 are high, the internal control signal IS is high; otherwise, low. When the internal control signal IS is high, a second drive control signal (DS2) is output from the OR gate 329C to the second multiplexer 326.

Since the internal control signal IS goes high once every eight frames as shown in FIG. 8, a second drive control signal (DS2) is output to the second multiplexer 326 once every eight frames in the embodiment. Here, the 3-bit counter 329A is used, thus the second drive control signal (DS2) is output once every $2^3$=8 frames. If a 2-bit counter is used, the second drive control signal (DS2) can be output once every $2^2$=4 frames; if a 4-bit counter is used, the signal can be reset once every $2^4$=16 frames.

Between two frames at the time an image changes sharply, the source image data difference between two picture elements of the frames is large, thus addition of error data to the same picture elements of the contiguous frames is not executed.

This can prevent a residual image from occurring and an image from instantaneously blurring when the picture element brightness difference between two frames lessens at the time an image changes sharply, particularly in animation.

Addition of error data every a given number of frames also for a still image prevents the error data in fairly previous frames from adversely affecting the display image of the current frame being processed. The error data related to an irrelevant image does not affect the display image, leading to prevention of flickering, etc.

Also, a still image can be followed accurately by resetting the error data (ED) to "000" every eight frames.

Since the source image data (SD) does not change to display a still image, for example, if source image data (SD) is "XXX0001", the error data (ED) always becomes "001". As it is added in sequence, the correction image data (HD) and image display data (GD) in each frame become as listed in Table 4.

TABLE 4

| No. of frame | Correction image data (HD) | Image display data (GD) |
|---|---|---|
| 1 | "xx001" | "xx0" |
| 2 | "xx0010" | "xx0" |
| 3 | "xx0011" | "xx0" |
| 4 | "xx0100" | "xx0" |
| 5 | "xx0101" | "xx0" |
| 6 | "xx0110" | "xx0" |
| 7 | "xx0111" | "xx0" |
| 8 | "xx1000" | "xx1" |

As listed above, when the error data (ED) becomes "001", a carry occurs on the least significant bit (LSB) of the image display data (GD) due to the error data (ED) once every eight frames, and the effect of interframe error diffusion appears. If the error data (ED) is greater than "001", a carry occurs on the image display data (GD) every a fewer number of frames than eight.

If the error data (ED) is reset to "000" every less than eight frames, in the instance given above, the error data (ED) is reset to "000" before a carry occurs on the image display data (GD) due to the error data (ED), thus the effect of interframe error diffusion does not appear. Therefore, if the error data consists of three bits for a still image, the interval at which the error data (ED) is reset to "000" must be a minimum of $2^3$=8 frames.

Likewise, the interval at which the error data (ED) is reset must be a minimum of $2^2$=4 frames when the error data is two bits; a minimum of $2^4$=16 frames when the error data is four bits; . . . ; a minimum of $2^n$ frames when the error data is n bits.

In the embodiment, the error data is three bits and is reset to "000" once every eight frames, the number of which satisfies the minimum requirement.

Therefore, if the error data (ED) is n bits, the error data (ED) is reset once every as many frames as an integer multiple of $2^n$, thereby covering even a still image without losing the effect of interframe error diffusion.

In the embodiment, the source image data frame memory 322 and the error data frame memory 327 are used as examples of storage means, the adder 324 as an example of addition means, the comparator 323 as an example of comparison means, the reset timing generator 329 as an example of auxiliary control means, and the second multiplexer 326 as an example of information generation means, but the configuration of the invention is not limited to them.

In the embodiment, the processor of 6-bit input, 3-bit output is described, but the embodiment is also applicable to a processor of 8-bit input, 3-bit output, a processor of 8-bit input, 4-bit output, and so forth.

[Fifth embodiment]

Figure 9:
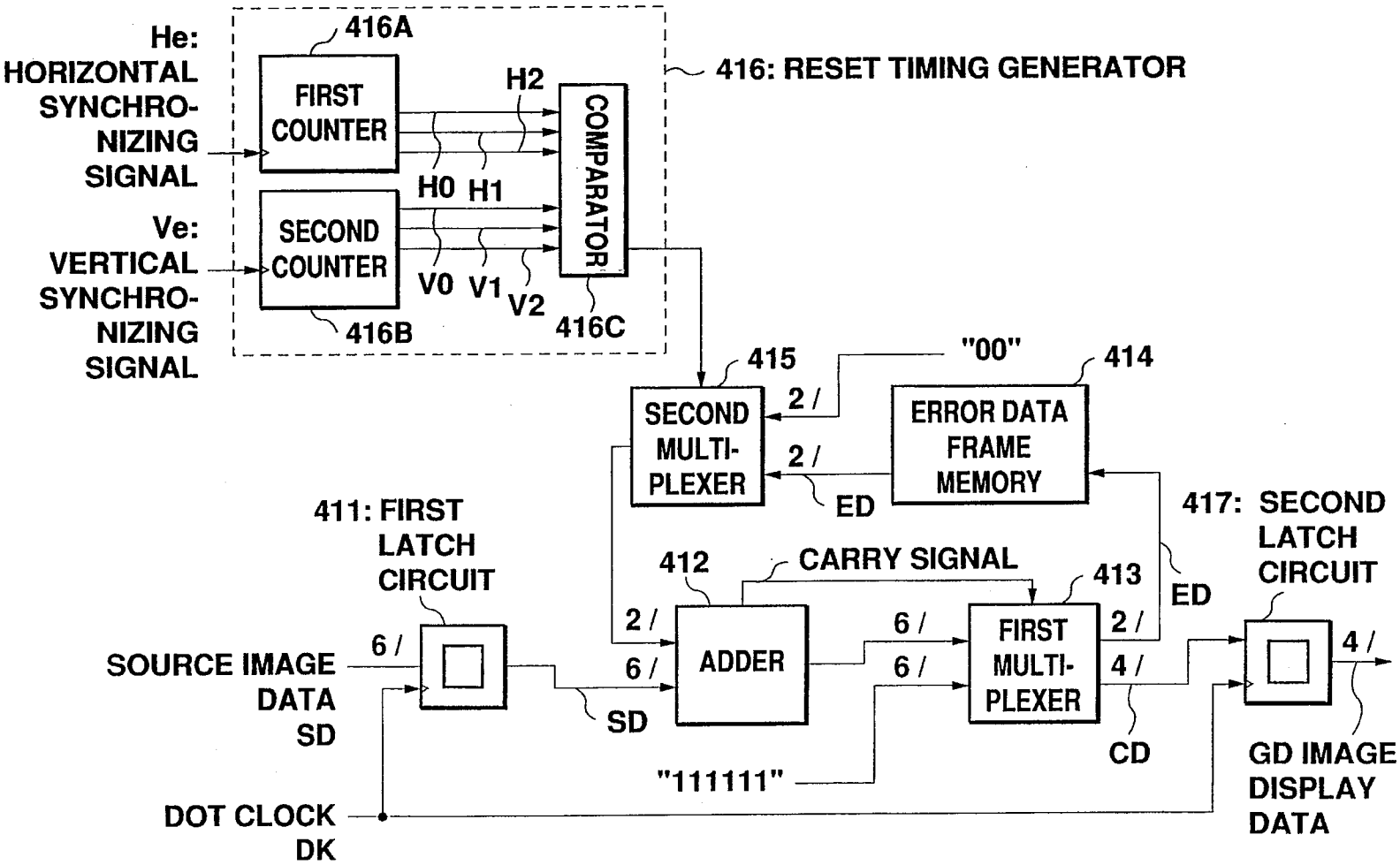
FIG. 9 is a block diagram of an image information processor according to a fifth embodiment of the invention.
Figure 10:
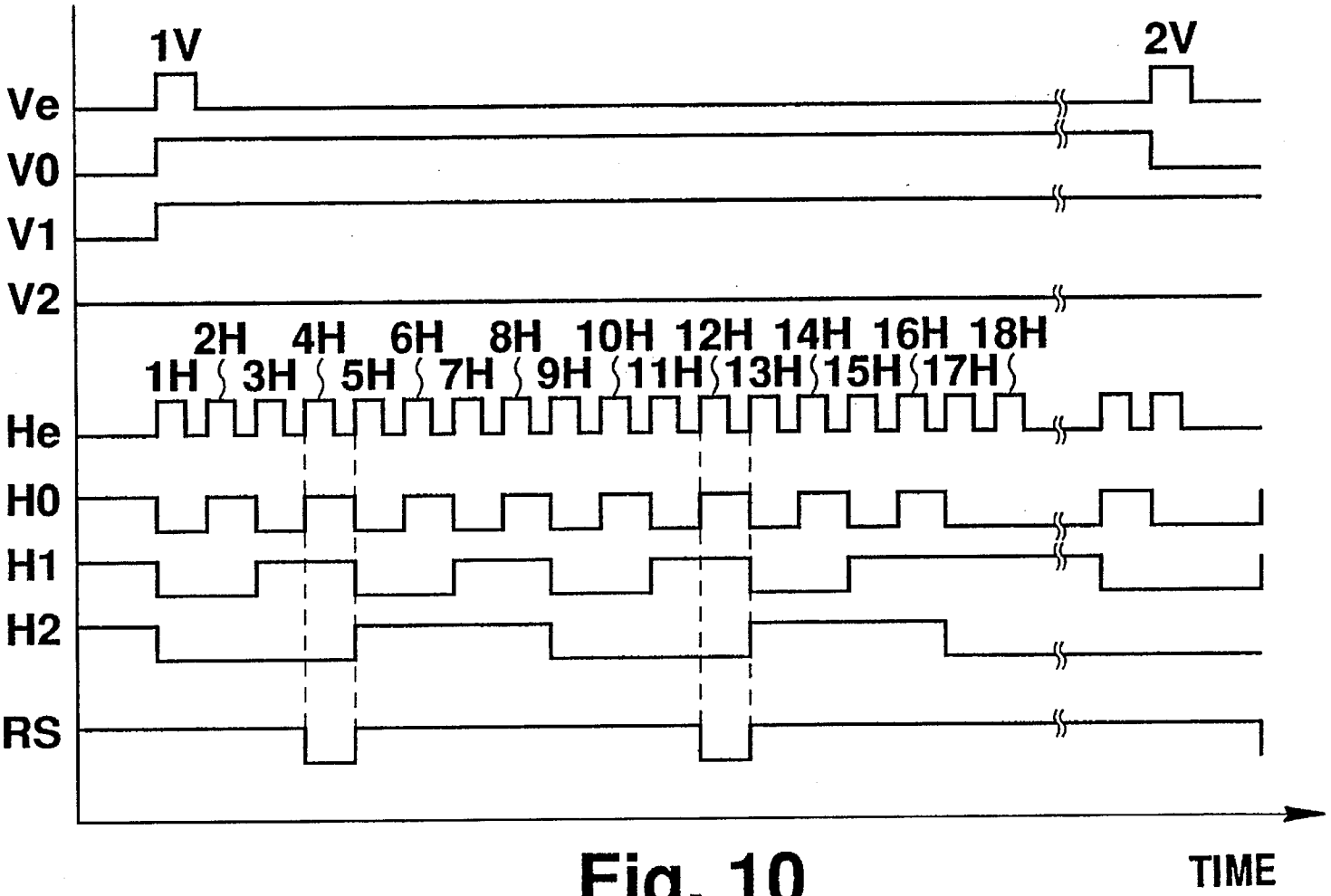
FIG. 10 is a first timing chart for describing the image information processing method according to the fifth embodiment of the invention.
Figure 11:
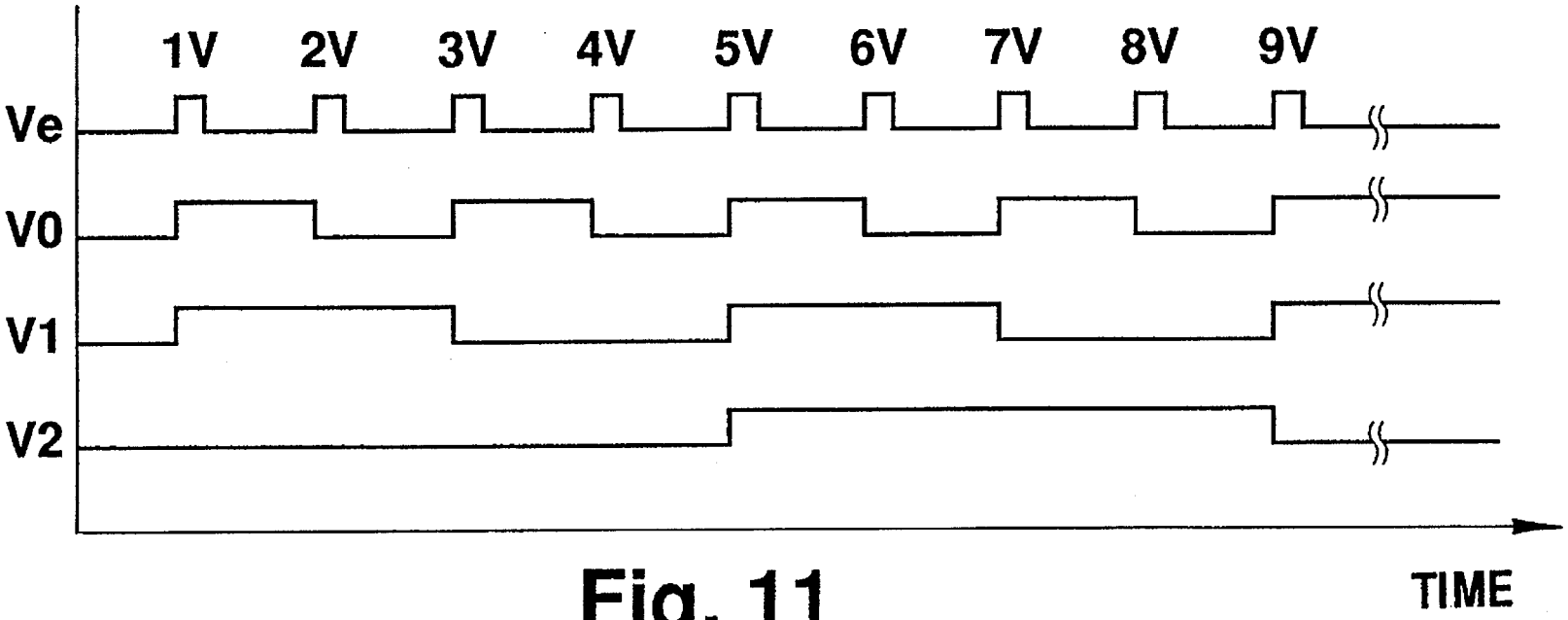
FIG. 11 is a second timing chart for describing the image information processing method according to the fifth embodiment of the invention.

Referring now to FIGS. 9 to 11, there is shown an image information processor according to a fifth embodiment of the invention.

The image information processor according to the fifth embodiment of the invention is located between an output section which outputs source image data (not shown) and an LCD driver which drives an LCD. The image information processor compresses 6-bit source image data into 4-bit image display data and outputs it to the LCD driver which inputs 4-bit data.

In such a case, the low-order two bits of the six bits of the source image data are discarded, and only the high-order four bits are used as image display data. Only 16 scales ($2^4$) would be able to be obtained without taking any additional measures. Thus, it is necessary to perform pseudo gradation processing for making a display image approach to the source image by pseudo representations. Description is given here only for data of red because similar processing for blue and green is performed concurrently by similar processors.

The image information processor according to the fifth embodiment of the invention comprises a first latch circuit 411, an adder 412, a first multiplexer 413, an error data frame memory 414, a second multiplexer 415, a reset timing generator 416, and a second latch circuit 417, as shown in FIG. 9.

The first latch circuit 411 is a circuit for once holding 6-bit input source image data (SD) of each frame and outputting the data to the adder 412 in response to a dot clock (DK).

The adder 412 adds the source image data (SD) and 2-bit error data (ED) output from the second multiplexer 215 and outputs the resultant 6-bit correction image data (HD).

The first multiplexer 413 divides the correction image data (HD) input from the adder 412 into the high-order four bits and the low-order two bits and outputs image display data (GD), the high-order four bits of the correction image data (HD), to the second latch circuit 415 and writes error data (ED), the low-order two bits, into the error data frame memory 414.

The error data frame memory 414 is a memory where the error data (ED), the low-order two bits of the correction image data (HD), is written/read; it holds the error data (ED) for each frame for the 1-frame period for output to the second multiplexer 415.

The second multiplexer 415 outputs the error data (ED) read from the error data frame memory 414 to the adder 412 when a drive control signal (RS) output from the reset timing generator 416 is high; and outputs 2-bit data "00" to the adder 412 when the signal is low. When the data "00" is selectively output, apparently the error data (ED) is reset.

The reset timing generator 416, which consists of a first counter 416A, a second counter 416B, and a comparator 416C, generates a drive control signal (RS) for driving the second multiplexer 415 in response to a vertical synchronizing signal Ve and a horizontal synchronizing signal He. The drive control signal (RS) is output low for each line in a frame, at the time of which apparently the error data (ED) is reset, that is, the data (ED) is reset for each line.

The first counter 416A divides the horizontal synchronizing signal He by 2, 4, and 8 to generate signals H0, H1, and H2 respectively, and outputs the signals to the comparator 416C.

The second counter 416B divides the vertical synchronizing signal Ve by 2, 4, and 8 to generate signals V0, V1, and V2 respectively, and outputs the signals to the comparator 416C.

The comparator 416C inputs the signals H0, H1, and H2 and the signals V0, V1, and V2 and compares them respectively, and if the signals H0 and V0 equal each other and the signals H1 and V1 equal each other and the signals H2 and V2 equal each other, outputs a drive control signal (RS) which is low to the second multiplexer 415; otherwise, outputs a drive control signal (RS) high to the second multiplexer 415.

The second latch circuit 417 is a circuit for once holding the image display data (GD) input from the first multiplexer 413 and outputting it to an external LCD driver (not shown) in response to a dot clock (DK).

As described above, the image information processor according to the fifth embodiment comprises the adder 412, the first multiplexer 413, the error data frame memory 414, and the reset timing generator 416, as shown in FIG. 9.

For example, the adder 412 adds the source image data (SD) of a picture element of the Nth frame and the error data (ED) corresponding to the picture element of the (N−1)st frame at the same position as the picture element of the Nth frame. The first multiplexer 413 outputs the high-order four bits of the 6-bit data resulting from the addition as image display data (GD) and the remaining 2-bit data as error data (ED) of the Nth frame. The reset timing generator 416 resets the error data (ED) to "00" for each line in each frame in response to the horizontal synchronizing signal He and vertical horizontal signal Ve.

The error data (ED) increasing gradually as frames are overlaid is reset to "00" for each line every a given number of frames, and the error data (ED) is not accumulated any more. Thus, the error data (ED) can affect the display image of each frame only within the range of near frames.

FIGS. 10 and 11 are timing charts for describing the image information processing method according to the fifth embodiment.

In the timing chart of FIG. 10, He is a horizontal synchronizing signal, and H0, H1, and H2 are signals provided by dividing the horizontal signal He by 2, 4, and 8 respectively. The signals H0, H1, and H2 are generated by the first counter 416A.

In the timing charts of FIGS. 10 and 11, Ve is a vertical synchronizing signal, and V0, V1, and V2 are signals provided by dividing the vertical signal Ve by 2, 4, and 8 respectively. The signals V0, V1, and V2 are generated by the second counter 416B.

RS is a drive control signal which is an output signal of the comparator 416C to which the signals V0, V1, and V2 are input.

The comparator 416C compares the signals, that is, H0 with V0, H1 with V1, and H2 with V2 for equality. When all the comparison results are "equal," the drive control signal RS goes low; otherwise, high. In the frame when the drive control signal RS is low, the second multiplexer 415 selectively outputs 2-bit data "00" instead of error data (ED), thus the error data (ED) at the time is reset to "00" apparently.

As shown in FIG. 10, in the first frame, during the fourth pulse 4H of the horizontal synchronizing signal He, V0=H0=high, V1=H1=high, and V2=H2=low are set, outputting the drive control signal low at the time. Likewise, during the twelfth pulse 12H of the horizontal synchronizing signal He, V0 =H0=high, V1=H1=high, and V2=H2=low are set, outputting the drive control signal low.

Thus, in the first frame, the error data is reset to "00" repeatedly at intervals of eight lines as the fourth line, 12th line, 20th line, 28th line, and so forth.

With respect to the second frame and later, the same timings as in the first frame are repeated for the signals H0, H1, and H2 generated from the horizontal synchronizing signal He and the horizontal synchronizing signal He.

On the other hand, with respect to the second frame, as shown at 2V in the timing chart of FIG. 11, V0 goes low, V1 is high, and V2 is low, thus the pulses of the horizontal synchronizing signal He during which the drive control signal is output low are the third pulse 3H, 11th pulse 11H, . . . during which H0 goes low, H1 goes high, and H2 is low, as shown in FIG. 10.

Therefore, in the second frame, the error data is reset to "00" repeatedly at intervals of eight lines as the third line, 11th line, 19th line, 27th line, and so forth.

Likewise, in the third frame, the error data is reset to "00" repeatedly at intervals of eight lines as the third line, 11th line, 19th line, 27th line, and so forth; in the fourth frame, the error data is reset to "00" repeatedly at intervals of eight lines as the first line, ninth line, 17th line, 25th line, and so forth.

Table 5 lists the relationship between the processed frames and lines where error data is reset to "00" for the first to eighth frames.

TABLE 5

| Processed frame | Lines where error data (ED) is reset to "00" | | | | | | | | |
|---|---|---|---|---|---|---|---|---|---|
| ① | 4 | 12 | 20 | 28 | 36 | 44 | 52 | 60 | 68 . . . |
| ② | 3 | 11 | 19 | 27 | 35 | 43 | 51 | 59 | 67 . . . |
| ③ | 2 | 10 | 18 | 26 | 34 | 42 | 50 | 58 | 66 . . . |
| ④ | 1 | 9 | 17 | 25 | 33 | 41 | 49 | 57 | 65 . . . |
| ⑤ | 8 | 16 | 24 | 32 | 40 | 48 | 56 | 64 | 72 . . . |
| ⑥ | 7 | 15 | 23 | 31 | 39 | 47 | 55 | 63 | 71 . . . |
| ⑦ | 6 | 14 | 22 | 30 | 38 | 46 | 54 | 62 | 70 . . . |
| ⑧ | 5 | 13 | 21 | 29 | 37 | 45 | 53 | 61 | 69 . . . |

As seen in Table 5 above, the error data (ED) can be reset to "00" for all lines in one frame in processing of up to the eighth frame. Therefore, for one line, the error data (ED) is reset to "00" once every eight frames.

The ninth frame and the later frames are processed as with the first to eighth frames. For the ninth frame, the error data (ED) for the fourth line, 12th line, . . . is reset to "00" as with the first frame; for the tenth frame, the error data (ED) for the third line, 11th line, . . . is reset to "00" as with the second frame.

The line where the error data (ED) is reset to "00" varies depending on the processed frame, as listed in Table 5. While eight frames are processed, the error data is reset to "00" for all lines. Therefore, the occurrence rate of flickering lessens as compared with the case in which the error data (ED) of all picture elements is reset at a time for each frame.

As described above, in the embodiment, the [N, M, n]th source image data (SD) and the [N–1, M, n]th error data (ED) are added. The high-order four bits of the 6-bit data resulting from the addition are output as the [N, M, n]th image display data (GD) and the low-order two bits are held as the [N, M, n]th error data (ED). The error data (ED) for a plurality of lines is reset to "00" at intervals of eight lines per frame while a plurality of lines where the error data (ED) is reset are changed so that the error data (ED) of all lines in each frame are reset once every eight frames, as listed in Table 5.

The error data of each picture element increasing gradually as frames are overlaid is reset at intervals of eight lines in each frame, and the error data (ED) of all lines is reset once every eight frames, thus is not accumulated exceeding eight frames.

This prevents the error data (ED) related to an irrelevant image in fairly previous frames from affecting the display image.

Since the error data is cleared every a plurality of lines while the lines where the error data is cleared are changed according to frames, flickering can be suppressed as much as possible as compared with the method of resetting the error data of all pictures in each frame at a time for each frame.

In the embodiment, the adder 412 is used as an example of addition means, the first multiplexer 413 as an example of information operation means, the error data frame memory 414 as an example of storage means, and the reset timing generator 416 as an example of information clear means, but the configuration of the invention is not limited to them.

In the embodiment, the processor of 6-bit input, 4-bit output is described, but the embodiment is also applicable to a processor of 8-bit input, 3-bit output, a processor of 6-bit input, 3-bit output, and so forth.

[Sixth embodiment]

Figure 13:
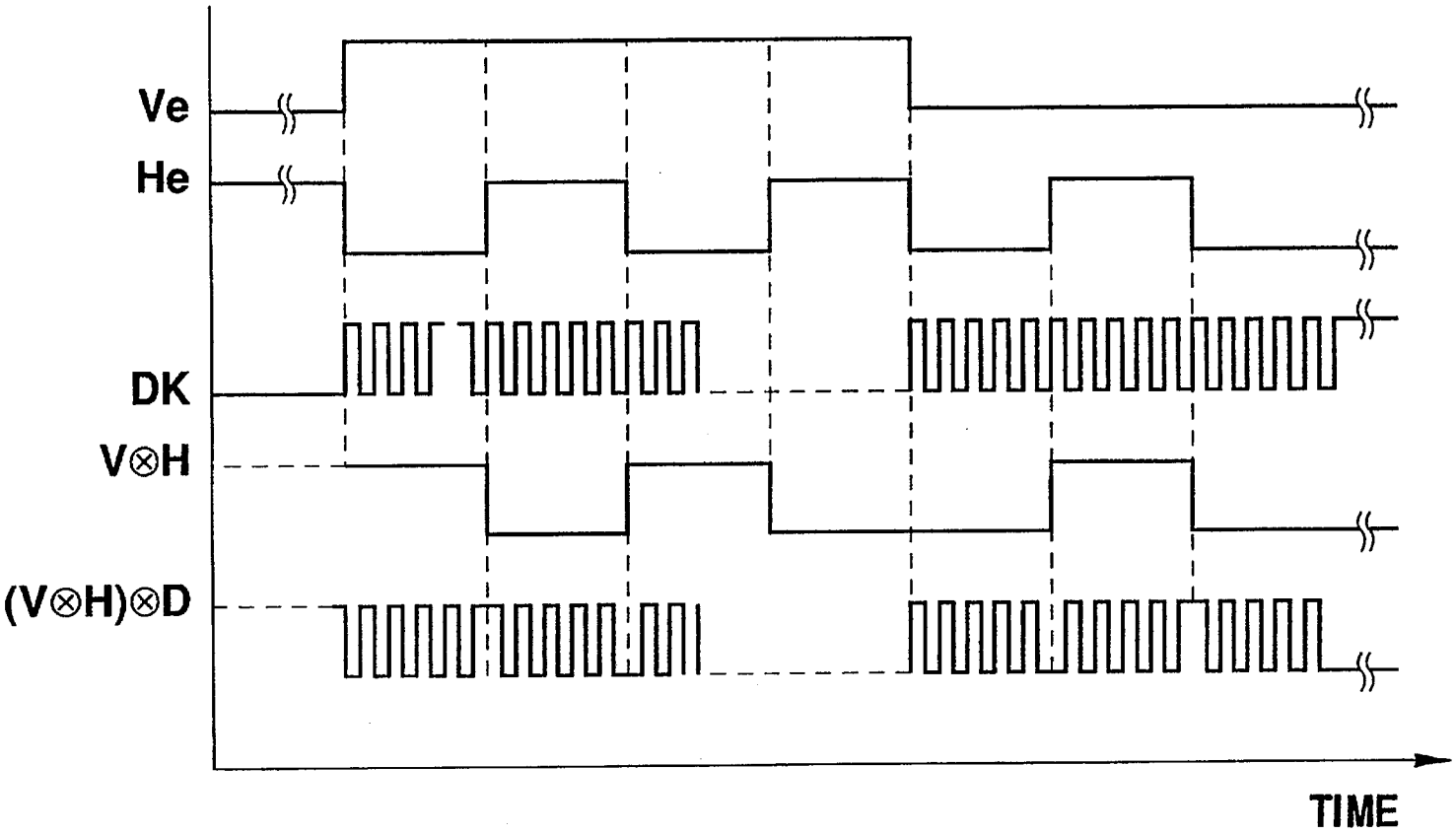
FIG. 13 is a timing chart for describing operation of a signal generation section according to the sixth embodiment of the invention.

Referring now to FIGS. 12 to 13, there is shown an image information processor according to a sixth embodiment of the invention.

The image information processor according to the sixth embodiment of the invention is located between an output section which outputs source image data (not shown) and an LCD driver which drives an LCD. The image information processor compresses 6-bit source image data into 3-bit image display data and outputs it to the LCD driver which inputs 3-bit data.

The image information processor according to the sixth embodiment consists of an inframe processing section 520, a signal generation section 521, an addition processing section 522, and an image display data generation section 523, as shown in FIG. 12.

The inframe processing section 520, which consists of a first latch circuit 520A, a first adder 520B, a first multiplexer 520C, a second latch circuit 520D, and a third latch circuit 520E, compresses 6-bit source image data (SD) into 4-bit internal image process data (ID) for outputting to the addition processing section 522.

First, the functions of the components of the inframe processing section 520 are described. The first latch circuit 520A inputs 6-bit source image data (SD) and outputs it to the first adder 520B in synchronization with a dot clock (DK).

The first adder 520B adds the source image data (SD) and inframe error data (EI) read from the second latch circuit 520D to generate 6-bit correction image data (HD) and outputs the data (HD) to the first multiplexer 520C.

The first multiplexer 520C divides the input 6-bit correction image data (HD) into the high-order four bits and the low-order two bits and outputs the high-order four bits or the internal image process data (ID) to the third latch circuit 520E and the low-order two bits or the inframe error data (EI) to the second latch circuit 520D.

The second latch circuit 520D performs write/read processing of the 2-bit inframe error data (EI) and holds the inframe error data (EI) for each picture element for the period of one picture element in synchronization with a horizontal synchronizing signal He.

The third latch circuit 520E outputs the input 4-bit internal image process data (ID) to a second adder 522A.

Next, the signal generation section 521 is described. The signal generation section 521, which consists of a first flip-flop circuit 521A, a second flip-flop circuit 521B, a third flip-flop circuit 521C, a first exclusive-OR (XOR) circuit 521D, and a second XOR circuit 521E, outputs to gate means 521F a signal for masking the least significant bit (LSB) of internal image process data once for each frame instead of the interframe error data (EB) described in the preceding embodiments. The gate means 521F carries the LSB once every two frames for outputting to the addition processing section 522.

The first flip-flop circuit 521A divides a dot clock DK for outputting to the second XOR circuit 521E. The second flip-flop circuit 521B divides a horizontal synchronizing signal He for outputting to the first XOR circuit 521D. The third flip-flop circuit 521C divides a vertical synchronizing signal Ve for outputting to the first XOR circuit 521D.

The first XOR circuit 521D exclusive-ORs the divided horizontal synchronizing signal He and vertical synchronizing signal Ve and outputs the result to the second XOR circuit 521E. The second XOR circuit 521E exclusive-ORs the output signal from the first XOR circuit 521D and the divided dot clock DK and outputs the result to the AND gate 521F. The AND gate 521F ANDs the output signal from the second XOR circuit 521E and the LSB of internal image process data (ID) output from the lnframe processing section 520 and forcibly outputs data 0 once every two frames and carries the LSB of the internal process data (ID) once every two frames and outputs the result to the second adder 522A.

The addition processing section 522, which consists of only a second adder 522A, adds the LSB of the internal image process data (ID) carried and output once every two frames from the AND gate 521F and the high-order three bits of the internal image process data (ID) output from the inframe processing section 520 and outputs the result, namely, 3-bit correction data (JD) and a carry signal to the image display data generation section 523.

The image display data generation section 523, which consists of a second multiplexer 523A and a fourth latch circuit 523B, outputs the input 3-bit internal image process data (ID) as 3-bit image display data (GD). At the time, if a carry results from the second addition and "000" is output, the source image data becomes a greatly different value. Thus, when the carry (signal) is set to "1," "111" is output from the second multiplexer 523A.

The fourth latch circuit 523B once holds the image display data (GD) input from the second multiplexer 523A and then outputs it to an external LCD driver (not shown) in response to a dot clock DK.

As described above, since the LSB of the internal image process data (ID) is carried once every two frames for outputting to the addition processing section, it produces a similar effect to outputting of interframe error data to be added to the 4-bit internal image process data (ID), eliminating the need for the formerly necessary memory for interframe error data having a huge number of bits.

FIGS. 13 is a timing chart for describing the image information processing method according to the six embodiment.

The signals generated by the signal generation section 521 are described with reference to the timing chart in FIG. 13.

First, a dot clock DK is input to the first flip-flop circuit 521A of the signal generation section 521, a horizontal synchronizing signal He to the second flip-flop circuit 521B, and a vertical synchronizing signal Ve to the third flip-flop 521C circuit for dividing.

The divided vertical synchronizing signal Ve and horizontal synchronizing signal He are output to the first XOR circuit 521D which then exclusive-ORs the input signals and outputs the result to the second XOR circuit 521E.

On the other hand, the divided dot clock DK is output to the second XOR circuit 521E which then exclusive-ORs the divided dot clock DK and the output signal from the first XOR circuit 521D and outputs the result to the AND gate 521F.

The signal output to the AND gate 521F takes a signal waveform having the relationship as shown in the timing chart. First, the vertical synchronizing signal Ve and the horizontal synchronizing signal He are exclusive-ORed, next the result and the dot clock DK are exclusive-ORed, thereby providing the inverted signal for each dot, for each line, and for each frame.

As described above, in the embodiment, the LSB of the 4-bit internal image process data (ID) generated by processing the source image data (SD) of picture element of the Nth frame (N is a natural number of 2 or greater) by the inframe processing section is carried once every two frames and the result and the high-order three bits of the internal image process data (ID) are added to generate the 3-bit correction data (JD) of the Nth frame.

The formerly required error data frame memory of an enormous number of bits is made unnecessary for the following reason:

If a display image is considered in two contiguous frames, it can be regarded as a still image, and source image data (SD) which remains substantially unchanged is output.

Therefore, if 1-bit interframe error data is added to internal image process data (ID) whose LSB is "1", such as "0101", in the conventional method, the relationships listed in Table 6 are obtained.

TABLE 6

| | Correction data corresponding to the frame (JD) | Addition result of interframe error data | Interframe error data added to the next frame |
|---|---|---|---|
| 1st frame | "0101" | "0101" | "1" |
| 2nd frame | "0101" | "0110" | "0" |
| 3rd frame | "0101" | "0101" | "1" |
| 4th frame | "0101" | "0110" | "0" |
| 5th frame | "0101" | "0101" | "1" |
| .... | .... | .... | .... |

Here, the interframe error data to be added to the next frame is noted. Every two frames, "1" and "0" are alternately output.

If the data and the LSB are added, a carry will occur once every two frames.

Therefore, in such a case, without calculating interframe error data, the LSB is carried once every two frames and added to the high-order three bits of the internal image process data (ID), thereby producing a similar effect to reading of interframe error data (EB) from an error data frame memory for addition.

Therefore, outputting of such signal eliminates the need for the formerly required error data frame memory of an enormous number of bits.

However, if "1", "0", "1", "0", . . . are simply added to frames, the frame to which 1 is added becomes bright and that to which 0 is added becomes dark. When an alternating pattern of bright and dark frames is repeated, it will be recognized as flickering of an image.

Then, an attempt is made to average the brightness of frames by adding "1" and "0" alternately to lines in each frame in such a manner that "1" is added to the first line in the first frame, "0" is added to the second line, "1" is added to the third line, and so forth.

However, even if "1" and "0" are added alternately to lines, when the LCD driver performs line inversion drive, the LCD drive voltage of the line to which "1" is added shifts to a higher value and a DC constituent appears, causing the LCD display to stick, etc., leading to trouble on driving the LCD.

Then, "1" and "0" are alternately added to picture elements in such a manner that "1" is added to the first picture element, "0" is added to the second picture element, "1" is added to the third picture element, and so forth, thereby suppressing shifting to a higher value the LCD drive voltage of the line to which "1" is added and cutting the DC constituent of the drive voltage.

The signals inverted for each frame, for each line, for each dot are output by the signal generation section, thereby suppressing flickering of an image, appearance of a DC constituent in LCD drive voltage, etc., and producing a similar effect to reading of interframe error data from the error data frame memory for addition in the preceding embodiments.

In the embodiment, the inframe processing section 520 is used as an example of inframe processing means, the signal generation section 521 as an example of signal generation means, the addition processing section 522 as an example of addition means, and the image display data generation section 523 as an example of operational means, and the internal image process data (ID) is used as an example of (L+1)-bit image data and the correction data (JD) as an example of (L+1)-bit correction image data, but the configuration of the invention is not limited to them.

In the embodiment, the image information processor of 6-bit input, 3-bit output is described, but the embodiment is also applicable to an image information processor of 8-bit input, 3-bit output, an image information processor of 8-bit input, 4-bit output, and so forth.

[Seventh embodiment]

Figure 14:
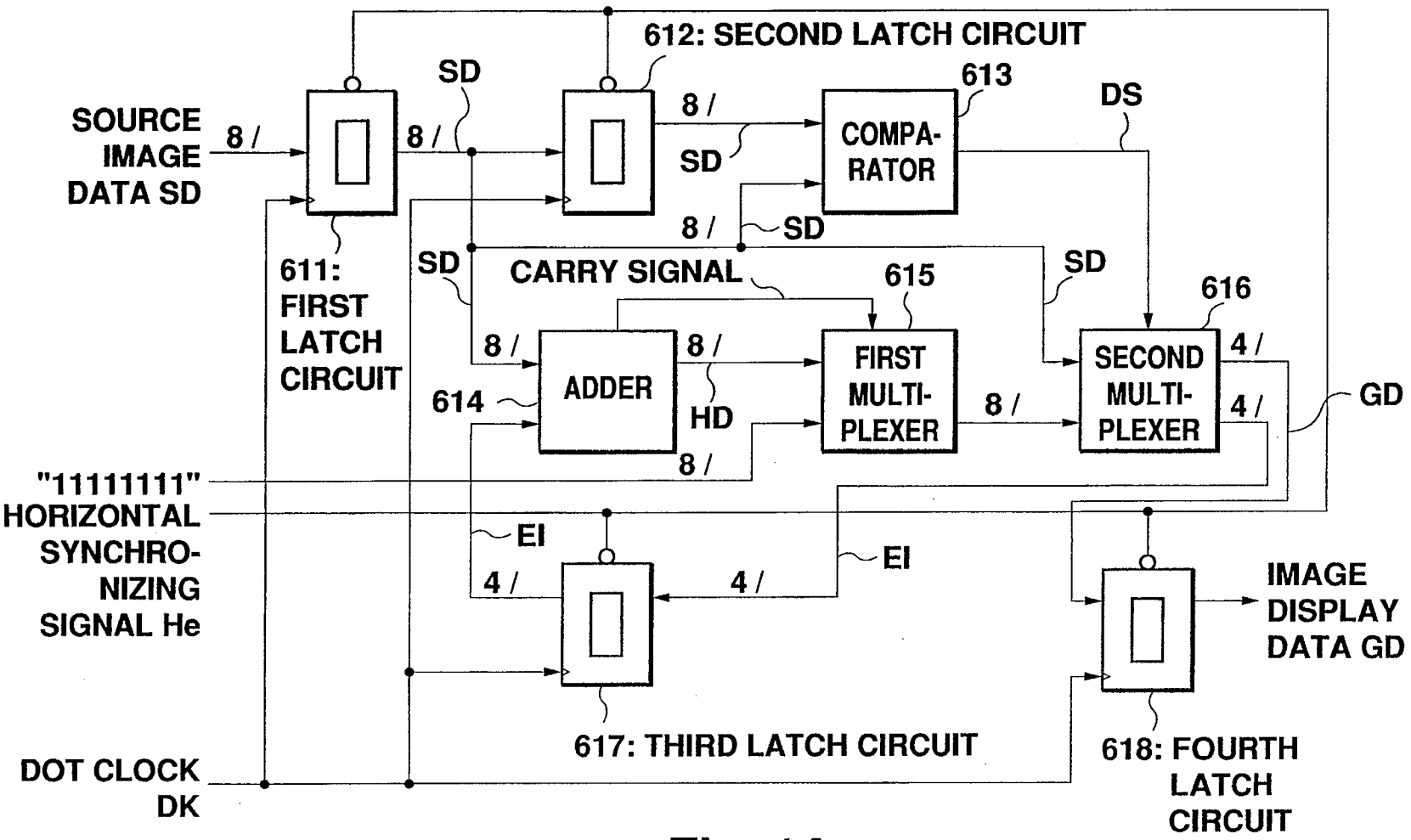
FIG. 14 is a block diagram of an image information processor according to a seventh embodiment of the invention.

Referring now to FIG. 14, there is shown an image information processor according to a seventh embodiment of the invention.

The image information processor according to the seventh embodiment of the invention is located between an output section which outputs source image data (not shown) and an LCD driver which drives an LCD. The image information processor compresses 8-bit source image data into 4-bit image display data and outputs it to the LCD driver which inputs 4-bit data.

In such a case, the low-order four bits of the eight bits of the source image data are discarded, and only the high-order four bits are used as image display data. Only 16 scales ($2^4$) would be able to be obtained without taking any additional measures. Thus, it is necessary to perform pseudo gradation processing for making a display image approach to the source image by pseudo representations. Description is given here only for data of red because similar processing for blue and green is performed concurrently by similar processors.

The image information processor according to the seventh embodiment of the invention comprises a first latch circuit 611, a second latch circuit 612, a comparator 613, an adder 614, a first multiplexer 615, a second multiplexer 616, a third latch circuit 617, and a fourth latch circuit 618, as shown in FIG. 14. In the description to follow, the nth picture element of the Nth frame is referred to as the "[N, n]th picture element."

The first latch circuit 611 is a circuit for once holding 8-bit input source image data (SD) of each picture element and outputting the data to the second latch circuit 612, the comparator 613, and the adder 614 in response to a dot clock (DK).

The second latch circuit 612 is a circuit, for example, when the [N, n]th picture element is processed, for holding the source image data (SD) of the [N−1, n]th picture element for the period of one picture element in order to compare the source image data (SD) of the [N, n]th picture element with the source image data (SD) of the [N−1, n]th picture element and outputting the source image data (SD) of the [N−1, n]th picture element to the comparator 613.

The comparator 613 calculates the difference between the source image data (SD) of the [N−1, n]th picture element output from the second latch circuit 612 and the source image data (SD) of the [N, n]th picture element, and if the difference exceeds a preset threshold, outputs a drive control signal (DS) to the second multiplexer 616.

The adder 614 adds the 4-bit error data (EI) of the [N, n−1]st picture element read from the third latch circuit 617 and the 8-bit source image data (SD) of the [N, n]th picture element output from the first latch circuit 611 to generate 8-bit correction image data (HD) of the [N, n]th picture element and outputs the data (HD) to the first multiplexer 615.

The first multiplexer 615 outputs the 8-bit correction image data (HD) of the [N, n]th picture element to the second multiplexer 616.

The second multiplexer 616 generates 4-bit error data (EI) of the [N, n]th picture element and 4-bit image display data (GD) of the [N, n]th picture element based on either of the 8-bit correction image data (HD) of the [N, n]th picture element input from the first multiplexer 615 and the 8-bit source image data (SD) of the [N, n]th picture element input from the first latch circuit 611 in response to the drive control signal (DS) output from the comparator 613, and outputs the data EI and GD to the third latch circuit 617 and the fourth latch circuit 618 respectively.

For example, if the drive control signal (DS) is output from the comparator 613, the image display data (GD) and error data (EI) of the [N, n]th picture element are generated based on the source image data (SD) of the [N, n]th picture element; if the drive control signal (DS) is not output, the image display data (GD) and error data (EI) of the [N, n]th picture element are generated based on the correction image data (HD) of the [N, n]th picture element.

The third latch circuit 617 holds the error data (EI) for the period of one picture element for outputting to the adder 614.

The fourth latch circuit 618 outputs the image display data (GD) to the LCD driver (not shown) in response to a dot clock (DK).

As described above, the image information processor according to the seventh embodiment comprises the adder 614, the second multiplier 616, the second latch circuit 612, and the comparator 613.

For example, when the [N, n]th picture element is processed, the source image data (SD) of the [N−1, n]th picture element is temporarily held in the second latch circuit 612, then output to the comparator 613, and the error data (EI) of the [N−1, n]th picture element is added to the source image data (SD) of the [N, n]th picture element by the adder 614 to generate the 8-bit correction image data (HD) of the [N, n]th picture element, then the data HD is output to the second multiplexer 616. The difference between the source image data (SD) of the [N−1, n]th picture element and the source image data (SD) of the [N, n]th picture element is calculated by the comparator and if the difference exceeds a predetermined value, a drive control signal (DS) is output to the second multiplexer 616; if the difference does not exceed the predetermined value, the drive control signal (DS) is not output.

When the drive control signal (DS) is input to the second multiplexer 616, error diffusion is not made; the high-order four bits of the source image data (SD) of the [N, n]th picture element are output as the image display data (GD) of the [N, n]th picture element; when the drive control signal (DS) is not input, the high-order four bits of the 8-bit correction image data (HD) of the [N, n]th picture element resulting from error diffusion are output as the image display data (GD) of the [N, n]th picture element.

Thus, in a portion where an image changes sharply, the drive control signal (DS) is output from the comparator 613 to the second multiplexer 613. When the drive control signal (DS) is output, the error diffusion is not made by the second multiplexer 616 and the high-order four bits of the source image data (SD) of the [N, n]th picture element are used as the image display data (GD) intact.

Then, proper setting of the predetermined value makes it possible to suppress addition of the source image data (SD) and the error data (EI) of the contiguous picture elements in the portion where the image changes sharply (for example, an edge of the image); the image information processing method according to the seventh embodiment of the invention can be realized.

At an edge of an image which changes sharply, the difference between the source image data pieces with the edge between is large, thus addition of error data to the contiguous picture element is not executed and the high-order four bits of the [N, n]th source image data (HD) are used as the [N, n]th image display data (GD) intact and the low-order four bits are used as the [N, n]th error data (EI). This can prevent the edge portion from blurring when the brightness difference lessens between two picture elements with the edge between; an image with clear edges, near to the source image can be displayed.

In the embodiment, the second latch circuit 612 is used as an example of storage means, the comparator 613 as an example of comparison means, the adder 614 as an example of addition means, and the second multiplexer 616 as an example of information generation means, but the configuration of the invention is not limited to them.

In the embodiment, the processor of 8-bit input, 4-bit output is described, but the embodiment is also applicable to a processor of 8-bit input, 3-bit output, a processor of 6-bit input, 3-bit output, and so forth.

[Eighth embodiment]

Figure 15:
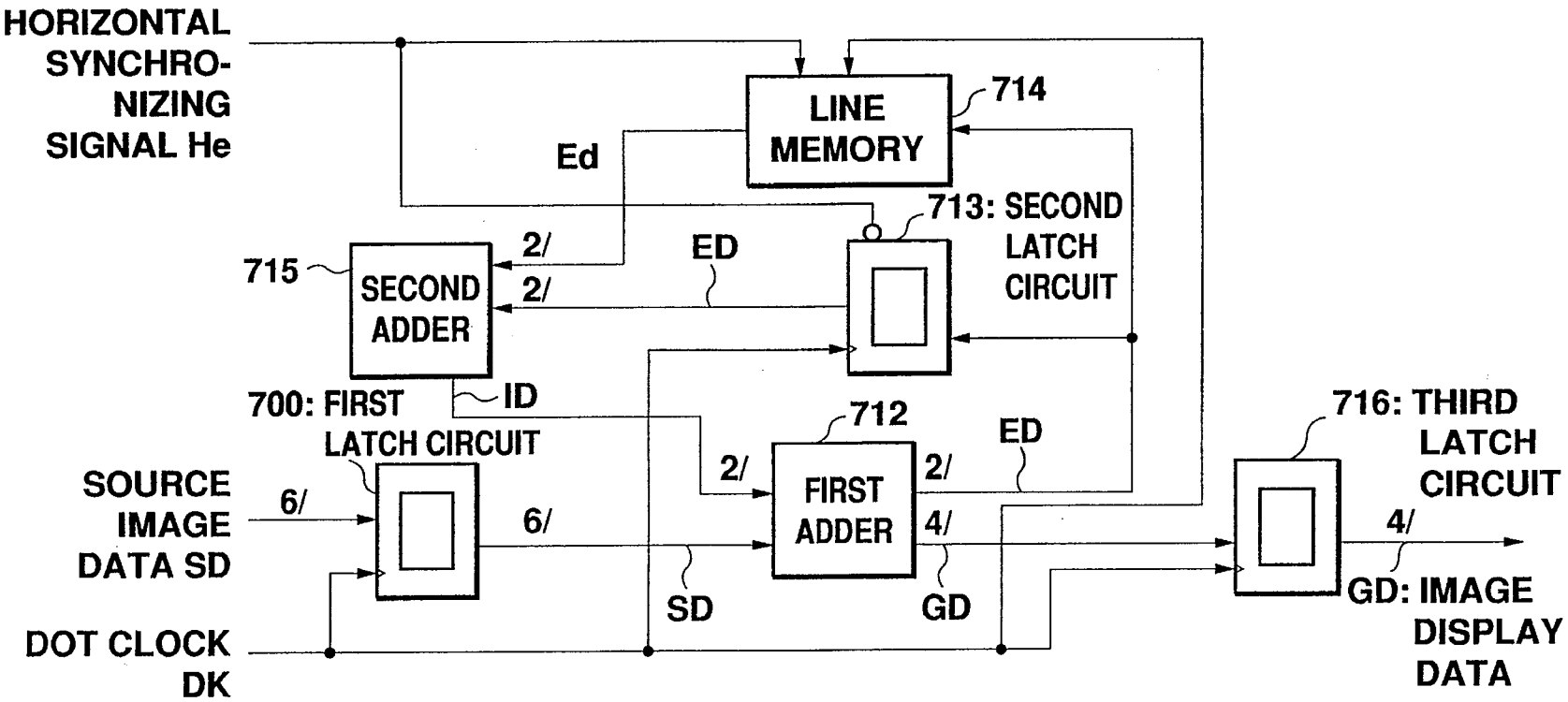
FIG. 15 is a block diagram of an image information processor according to an eighth embodiment of the invention.

Referring now to FIG. 15, there is shown an image information processor according to an eighth embodiment of the invention.

The image information processor according to the eighth embodiment of the invention is located between an output section which outputs source image data (not shown) and an LCD driver which drives an LCD. The image information processor compresses 6-bit source image data into 3-bit image display data and outputs it to the LCD driver which inputs 3-bit data.

In such a case, the low-order three bits of the six bits of the source image data are discarded, and only the high-order three bits are used as image display data. Only eight scales ($2^3$) would be able to be obtained without taking any additional measures. Thus, it is necessary to perform pseudo gradation processing for making a display image approach to the source image by pseudo representations. Description is given here only for data of red because similar processing for blue and green is performed concurrently by similar processors.

The image information processor according to the eighth embodiment of the invention comprises a first latch circuit 711, a first adder 712, a second latch 713, a line memory 714, a second adder 715, a third latch circuit 716, as shown in FIG. 15.

The first latch circuit 711 once holds 6-bit source image data (SD) for outputting to the first adder 712.

The first adder 712 adds 2-bit internal image process data (ID) output from the second adder 715 and the source image data (SD) and outputs the high-order four bits of the addition result to the third latch circuit 716 as image display data (GD) and the low-order two bits to the second latch circuit 713 as error data (ED).

The second latch circuit 713 holds the error data (ED) for the period of one picture element for outputting to the second adder 715.

The line memory 714 holds the error data for the period of one line, then outputs it to the second adder 615 as the error data (Ed) of picture element of the immediately preceding line.

The second adder 615 adds the error data (ED) of the immediately preceding picture element and the error data (Ed) of picture element of the immediately preceding line and outputs the high-order two bits of the 3-bit addition result to the first adder 612 as internal image process data (ID).

The third latch circuit 616 once holds the image display data (GD) for outputting to the LCD driver (not shown).

The reason why the value of the high-order two bits of the 3-bit data of the addition result of the [N–1, n]th error data (Ed) and the [N, n–1]st error data (ED) becomes half of the addition result is described with reference to Table 7.

TABLE 7

| ① ED | ② Ed | ③ ED + Ed | ④ EE | ⑤ (ED + Ed)/2 |
|---|---|---|---|---|
| 00 | 00 | 000 | 00 | 00 |
| 01 | 00 | 001 | 00 | 00 |
| 10 | 00 | 010 | 01 | 01 |
| 11 | 00 | 011 | 01 | 01 |
| 00 | 01 | 001 | 00 | 00 |
| 01 | 01 | 010 | 01 | 01 |
| 10 | 01 | 011 | 01 | 01 |
| 11 | 01 | 100 | 10 | 10 |
| 00 | 10 | 010 | 01 | 01 |
| 01 | 10 | 011 | 01 | 01 |
| 10 | 10 | 100 | 10 | 10 |
| 11 | 10 | 101 | 10 | 10 |
| 00 | 11 | 011 | 01 | 01 |
| 01 | 11 | 100 | 10 | 10 |
| 10 | 11 | 101 | 10 | 10 |
| 11 | 11 | 110 | 11 | 11 |

Table 7 lists 1 [N, n]th error data (ED), 2 [N–1, n]th error data (Ed), 3 addition result (ED+Ed) of [N, n]th error data (ED) and [N–1, n]th error data (Ed), 4 internal image process data (ID), and 5½ data [(ED+Ed)/2] of addition result (ED+Ed) of [N, n]th error data (ED) and [N–1, n]th error data (Ed).

In 5½ data [(ED+Ed)/2] of addition result (ED+Ed) of [N, n]th error data (ED) and [N–1, n]th error data (Ed), the remainders of division by 2 are discarded.

For example, on the eighth row from the top of Table 7 where 1 [N, n]th error data (ED) is "11" and 2 [N–1, n]th error data (Ed) is "01," the addition result (ED+Ed) is "100" as listed under 3. The value of the high-order two bits of the data is "10," as listed under 4, which matches "10," the half value of the addition result (ED+Ed) listed under 5.

On the seventh row from the top of Table 7 where 1 [N, n]th error data (ED) is "10" and 2 [N–1, n]th error data (Ed) is "01," the addition result (ED+Ed) is "011" as listed under 3. The value of the high-order two bits of the data is "01," as listed under 4, which matches "01," the half value of the addition result (ED+Ed) listed under 5. Strictly, the addition result (ED+Ed) cannot be divided by 2, but the remainder is discarded under 5 and 5 half value of the addition result (ED+Ed) becomes "01" which matches the value under 4.

Likewise, as seen in Table 7, the value of the high-order two bits of the 3-bit data of the addition result of the [N−1, n]th error data (Ed) and the [N, n−1]st error data (ED) becomes half of the addition result with respect to 3-bit data of 2-bit addition results.

Although the [N−1, n]th error data (Ed) and the [N, n−1]st error data (ED) are each 2-bit data in the embodiment, the same effect is produced if they are each 3- or 4-bit data.

As described above, the image information processor according to the eighth embodiment comprises the first adder 712, the second latch 713, the line memory 714, and the second adder 715.

For example, the first adder 712 adds internal image process data (ID) and source image data (SD) to generate 2-bit error data (ED) and 4-bit image display data (GD) and outputs the 2-bit error data (ED) to the second latch circuit 713 and the line memory 714. The second adder 715 adds 2-bit error data (Ed) of picture element of the immediately preceding line and the 2-bit error data (ED) of the immediately preceding picture element and outputs internal image process data (ID) which are the high-order two bits of the 3-bit data resulting from the addition to the first adder 712. The line memory 714 holds the 2-bit error data (ED) for the period of one line for outputting to the second adder 715 as the error data (Ed) of picture element of the immediately preceding line. The second latch circuit 713 holds the 2-bit error data (ED) for the period of one picture element for outputting to the second adder 715 as the error data (ED) of the immediately preceding picture element.

At the time, as listed in Table 7, the 2-bit internal image process data (ID) provided by the second adder 715 becomes equal to a half of the addition result of the 2-bit [N−1, n]th error data (Ed) and the 2-bit [N, n−1]st error data (ED).

This eliminates the need for a device such as a divider requiring a complicated configuration to find data of a half of the 3-bit data resulting from adding the [N−1, n]th error data (Ed) and [N, n−1]st error data (ED), preventing the circuit configuration from becoming complicated.

Addition of the internal image process data (ID) thus found and source image data (SD) of one picture element by the first adder 712 means that added to the source image data (SD) of one picture element are data of a half of the error data (Ed) of picture element of the immediately preceding line ([N−1, n]th picture element) and data of a half of the error data (ED) of the immediately preceding picture element ([N, n−1]st picture element) and has the same meaning as addition of a half of the error data (ED) of one picture element to each of the source image data (SD) of the picture element just following the picture element and the source image data (SD) of the picture element just below that picture element.

Thus, as compared with a conventional processor which adds all error data (ED) only to the source image data (SD) of the just following picture element, a half of the error data (ED) is also added to the source image data (SD) of the picture element just below; therefore, the brightness difference from contiguous picture elements lessens much more and the display brightness can be smoothed, enabling a display image to be made nearer to the source image.

In the embodiment, the first adder 712 is used as an example of first operational means, the second adder 715 as an example of second operational means, the line memory 714 as an example of first storage means, and the second latch circuit 713 as an example of second storage means, but the configuration of the invention is not limited to them.

In the embodiment, the processor of 6-bit input, 3-bit output is described, but the embodiment is also applicable to a processor of 8-bit input, 3-bit output, a processor of 8-bit input, 4-bit output, and so forth.

[Ninth embodiment]

Referring now to FIGS. 16 to 20, there is shown an image information processor according to a ninth embodiment of the invention.

The image information processor according to the ninth embodiment of the invention is located between an output section which outputs source image data and an LCD driver which drives an LCD. The image information processor compresses 6-bit source image data (SD) and outputs three types of image display data (GD1-GD3) applicable to different types of LCD drivers.

The image information processor according to the ninth embodiment of the invention comprises an inframe processing circuit 811, a first selector 812, an interframe error diffusion circuit 813, an STN time series operation processing circuit 814, a TFT time series operation processing circuit 815, and a second selector 816.

First, the inframe processing circuit 811 is described. The inframe processing circuit 811 processes 6-bit source image data (SD) input by an error diffusion method in a frame and generates first 4-bit internal image process data (ID1), second 3-bit internal image process data (ID2), or third 5-bit internal image process data (ID3) in response to a mode switch signal (SS).

Figure 17:
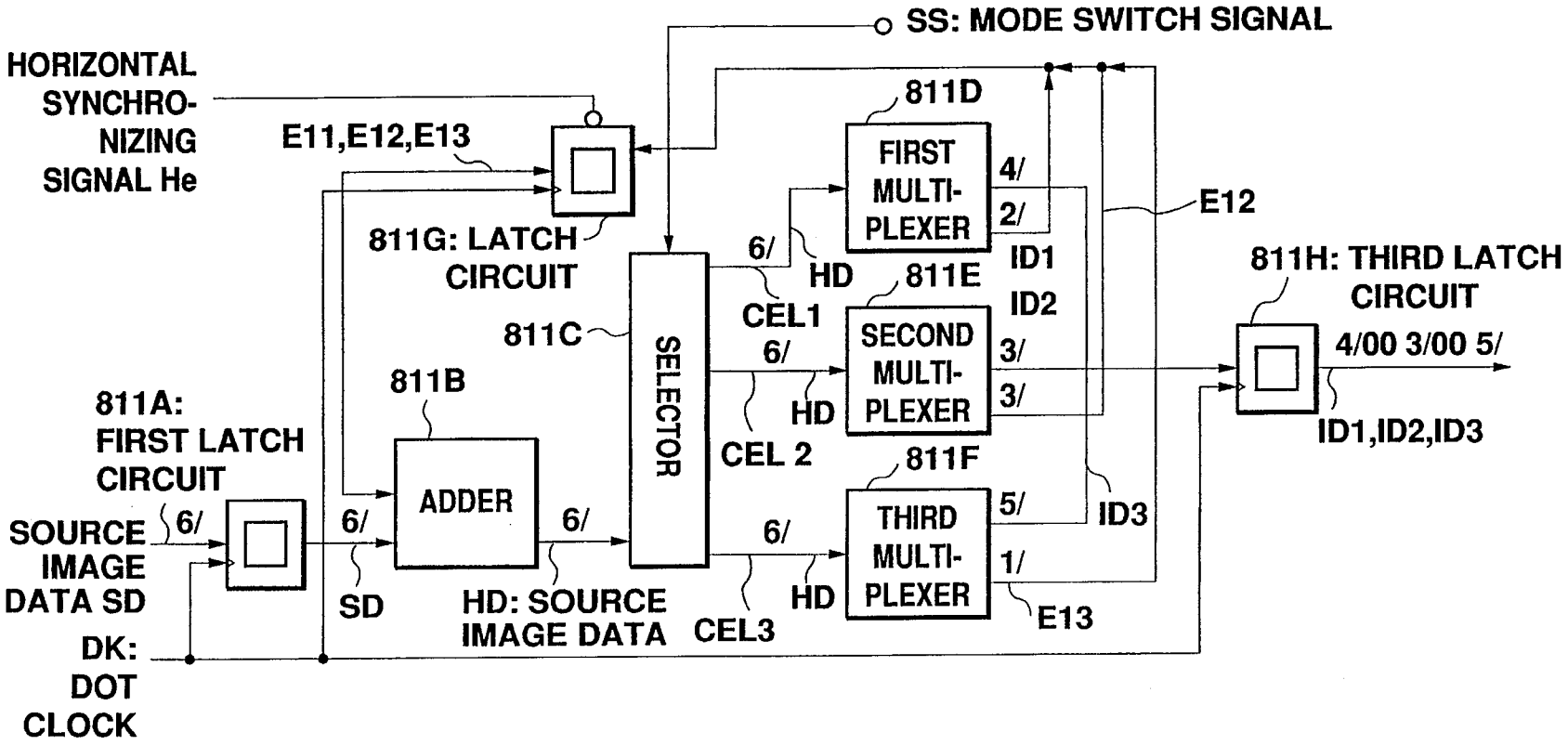
FIG. 17 is a block diagram of an inframe processing circuit according to the ninth embodiment of the invention.

The inframe processing circuit 811 consists of a first latch circuit 811A, an adder 811B, a selector 811C, a first multiplexer 811D, a second multiplexer 811E, a third multiplexer 811F, a second latch circuit 811G, and a third latch circuit 811H, as shown in FIG. 17.

The first latch circuit 811A outputs 6-bit source image data (SD) input to the adder 811B in synchronization with a dot clock (DK).

The adder 811B adds the source image data (SD) and first to third Inframe error data (EL1–EI3) read from the second latch circuit 811G to generate 6-bit correction image data (HD), and outputs the data (HD) to the selector 811C.

The selector 811C selectively outputs the correction image data (HD) to any of the first multiplexer 811D, second multiplexer 811E, and third multiplexer 811F in response to a mode switch signal (SS).

The first multiplexer 811D divides the 6-bit correction image data (HD) input into the high-order four bits and the low-order two bits and outputs the high-order four bits, namely, first internal image process data (ID1) to the third latch circuit 811H and the low-order two bits, namely, first inframe error data (EI1) to the second latch circuit 811G.

The second multiplexer 811E divides the 6-bit correction image data (HD) input into the high-order three bits and the low-order three bits and outputs the high-order three bits, namely, second internal image process data (ID2) to the third latch circuit 811H and the low-order three bits, namely, second inframe error data (EI2) to the second latch circuit 811G.

The third multiplexer 811F divides the 6-bit correction image data (HD) input into the high-order five bits and the low-order one bit and outputs the high-order five bits, namely, third internal image process data (ID3) to the third latch circuit 811H and the low-order one bit, namely, third inframe error data (EI3) to the second latch circuit 811G.

The second latch circuit 811G performs write/read processing of the first to third inframe error data (EL1–EI3). It holds the first to third inframe error data (EL1–EI3) for each picture element for the period of one picture element in synchronization with a dot clock DK and also initializes the error data to 0 for each line in synchronization with the timing of a horizontal synchronizing signal He.

The third latch circuit 811H outputs the first to third internal image process data (ID1–ID3) to the first selector 812.

Next, the first selector 812 is described. The first selector 812 selectively outputs the first 4-bit internal image process data (ID1), the second 3-bit internal image process data (ID2), the third 5-bit internal image process data (ID3), or the first 4-bit internal image process data (ID1) in response to a mode switch signal (SS) for selecting one of the outputs of the first to third multiplexers by first to third cells (CEL1–CEL3).

Next, the interframe error diffusion circuit 813 is described. The interframe error diffusion circuit 813 shown in FIG. 16 processes the first 4-bit internal image process data (ID1) input by interframe error diffusion, and outputs first 3-bit image display data (GD1) to the second selector 816.

Figure 18:
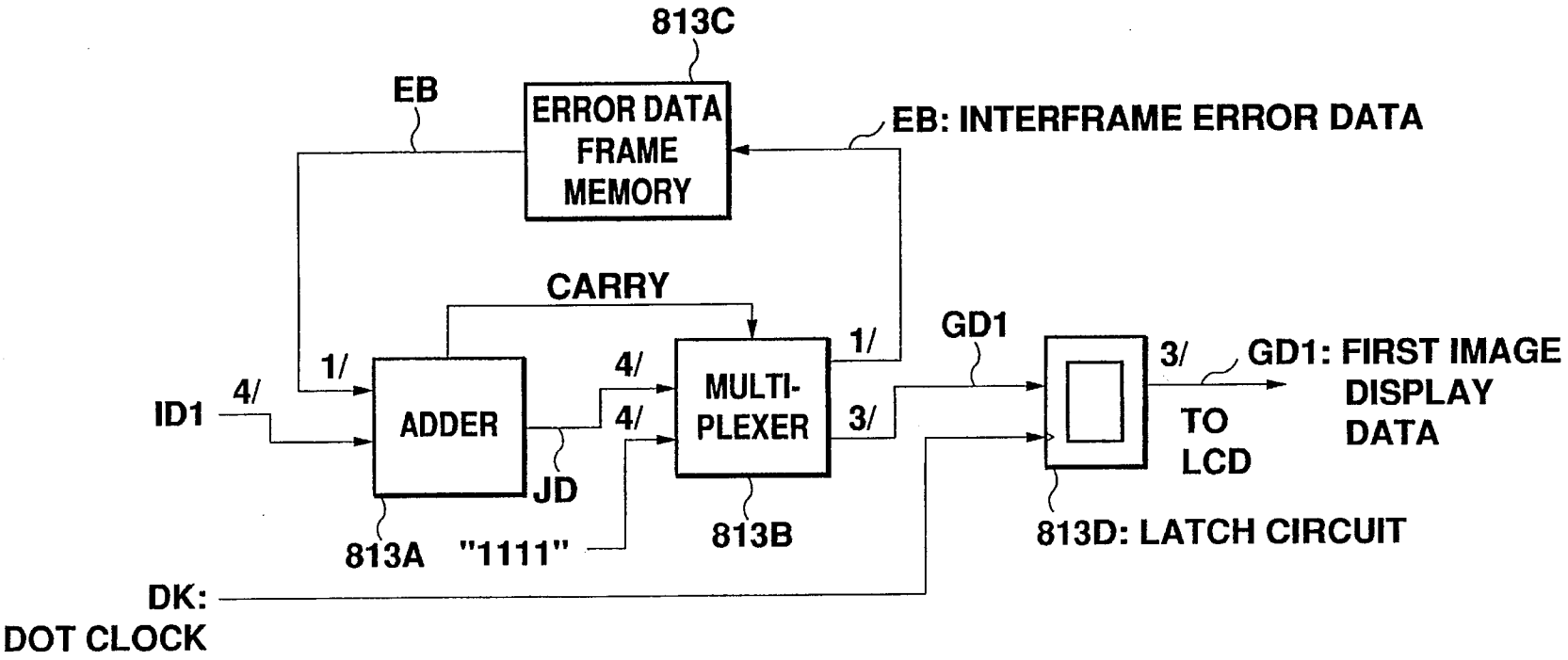
FIG. 18 is a block diagram of an interframe error diffusion circuit according to the ninth embodiment of the invention.

The interframe error diffusion circuit 813 consists of an adder 813A, a multiplexer 813B, an error data frame memory 813C, and a latch circuit 813D, as shown in FIG. 18.

The adder 813A adds first 4-bit internal image process data (ID1) input and 1-bit interframe error data (EB) read from the error data frame memory 813C and outputs the addition result, namely, 4-bit correction data (JD) to the multiplexer 813B.

The multiplexer 813B divides the 4-bit correction data (JD) input from the adder 813A into the high-order three bits and the low-order one bit and outputs the high-order three bits to the latch circuit 813D as first image display data (GD1) and the low-order one bit to the error data frame memory 813C as interframe error data (EB).

The error data frame memory 813C is provided for write/read processing of the interframe error data (EB) and holds the interframe error data (EB) for each frame for the 1-frame period.

The latch circuit 813D once holds the first image display data (GD1) input from the multiplexer 813B for outputting to the second selector 816 in response to a dot clock DK.

Next, the STN time series operation processing circuit 814 is described. The STN time series operation processing circuit 814 shown in FIG. 16, which is a circuit for application of the processor to an STN LCD driver, performs time series operation processing of second 3-bit internal image process data (ID2) input and then outputs second 1-bit image display data (GD2) to the second selector 816.

Figure 19:
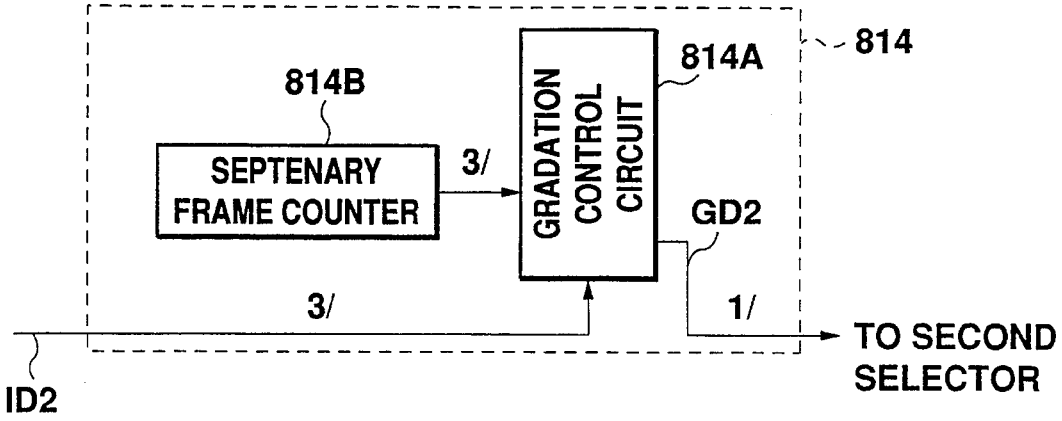
FIG. 19 is a block diagram of an STN time series operation processing circuit according to the ninth embodiment of the invention.

The STN time series operation processing circuit 814 consists of a gradation control circuit 814A and a septenary frame counter 814B, as shown in FIG. 19.

The gradation control circuit 814A generates second 1-bit image display data (GD2) related to driving the STN LCD driver from second 3-bit internal image process data (ID2) input and a 3-bit frame number output from the septenary frame counter 814B, and outputs the data (GD2) to the second selector 816 according to a matrix as listed in Table 8, for example.

TABLE 8

| | Counter input | | | | | | |
|---|---|---|---|---|---|---|---|
| Data input | 000 | 001 | 010 | 011 | 100 | 101 | 110 |
| 000 | 0 | 0 | 0 | 0 | 0 | 0 | 0 |
| 001 | 1 | 0 | 0 | 0 | 0 | 0 | 0 |
| 010 | 0 | 1 | 1 | 0 | 0 | 0 | 0 |
| 011 | 0 | 0 | 0 | 1 | 1 | 1 | 0 |
| 100 | 1 | 1 | 1 | 0 | 0 | 0 | 1 |
| 101 | 1 | 0 | 0 | 1 | 1 | 1 | 1 |
| 110 | 1 | 1 | 0 | 1 | 1 | 1 | 1 |
| 111 | 1 | 1 | 1 | 1 | 1 | 1 | 1 |

The frame counter 814B assigns eight numbers 0 to 7 to frames and outputs the numbers to the gradation control circuit 814A.

Next, the TFT time series operation processing circuit 815 is described. The TFT time series operation processing circuit 815 shown in FIG. 16, which is a circuit for application of the processor to a TFT LCD driver, performs time series operation processing of third 5-bit internal image process data (ID3) input and then outputs third 3-bit image display data (GD3) to the second selector 816.

Figure 20:
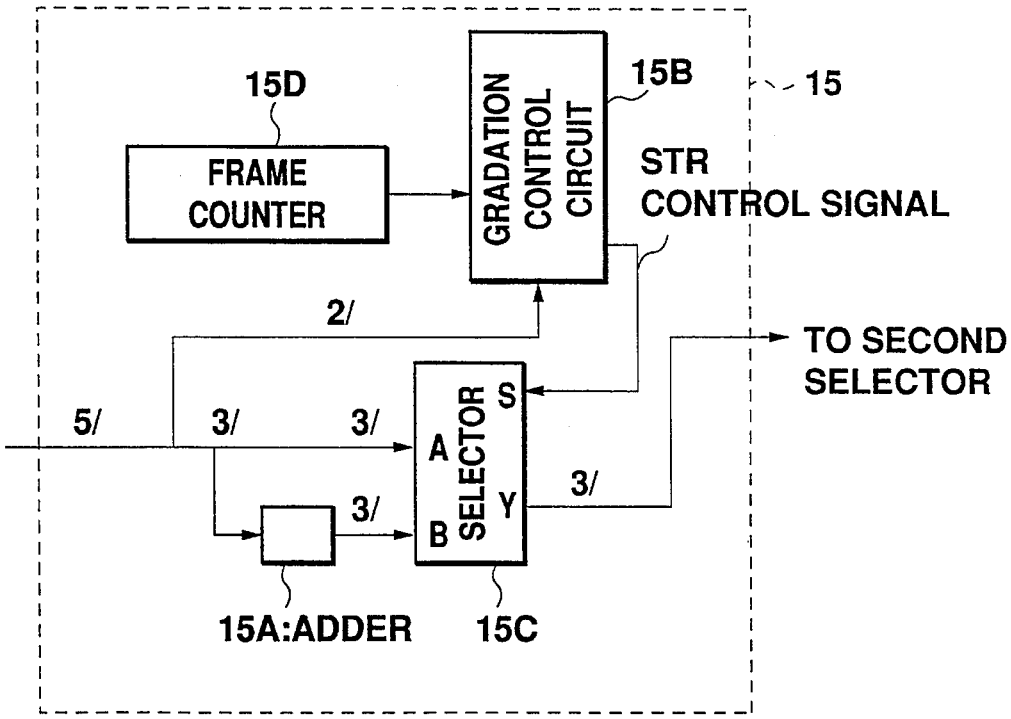
FIG. 20 is a block diagram of a TFT time series operation processing circuit according to the ninth embodiment of the invention.

The TFT time series operation processing circuit 815 consists of an adder 815A, a gradation control circuit 815B, a selector 815C, and a frame counter 815D, as shown in FIG. 20.

The adder 815A adds "1" to the high-order 3-bit data of third 5-bit internal image process data (ID3) output from the first selector 812.

The frame counter 815D assigns four numbers 0 to 3 to frames and outputs the numbers to the gradation control circuit 815B.

The gradation control circuit 815B generates a control signal (STR) for controlling an output of the selector 815C according to a matrix as listed in Table 9, for example, from the low-order 2-bit data of third 5-bit internal image process data (ID3) output from the first selector 812 and the 2-bit frame number output from the frame counter 815D.

TABLE 9

| | Counter input | | | |
|---|---|---|---|---|
| Data input | 00 | 01 | 10 | 11 |
| 00 | 0 | 0 | 0 | 0 |
| 01 | 1 | 0 | 0 | 0 |
| 10 | 1 | 0 | 1 | 0 |
| 11 | 1 | 1 | 1 | 0 |

The selector 815C selectively outputs either the high-order 3-bit data of third internal image process data (ID3) or the 3-bit data to which "1" is added, depending on the value of the control signal STR, 1 or 0.

The second selector 816 selectively outputs any of first 3-bit image display data (GD1), second 1-bit image display data (GD2), third 3-bit image display data (GD3), and first 4-bit internal image process data (ID1) to the LCD driver (not shown) in response to a mode switch signal SS.

In operation, first, 6-bit source image data (SD) is input to the inframe processing circuit 811 which then processes the data (SD) by the error diffusion method in a frame and generates first 4-bit internal image process data (ID1), second 3-bit internal image process data (ID2), or third 5-bit internal image process data (ID3) in response to a mode switch signal SS, then outputs the data to the first selector 812.

Next, the first internal image process data (ID1), the second internal image process data (ID2), the third internal image process data (ID3), or the first internal image process data (ID1) is selectively output from the first selector 812 in response to a mode switch signal SS.

Next, image information processing between frames is performed by the selected circuit and the generated image display data is output to the second selector 816. Next, any of the first to third image display data (GD1-GD3) and first internal image process data (ID1) is selectively output from the second selector 816 to the LCD driver (not shown).

Thus, in the embodiment, the first selector 812 selects any of the three circuits which perform interframe image information processing, the interframe error diffusion circuit 813, STN time series operation processing circuit 814, and TFT time series operation processing circuit 815, thereby enabling the processor to be applied to LCD drivers corresponding to the processing methods.

The operation of the image information processor is described in detail for each of the image information processing methods selected according to the LCD drivers.

When the image information processor is applied to an LCD driver corresponding to the interframe error diffusion method, the operation of the processor is described.

Figure 16:
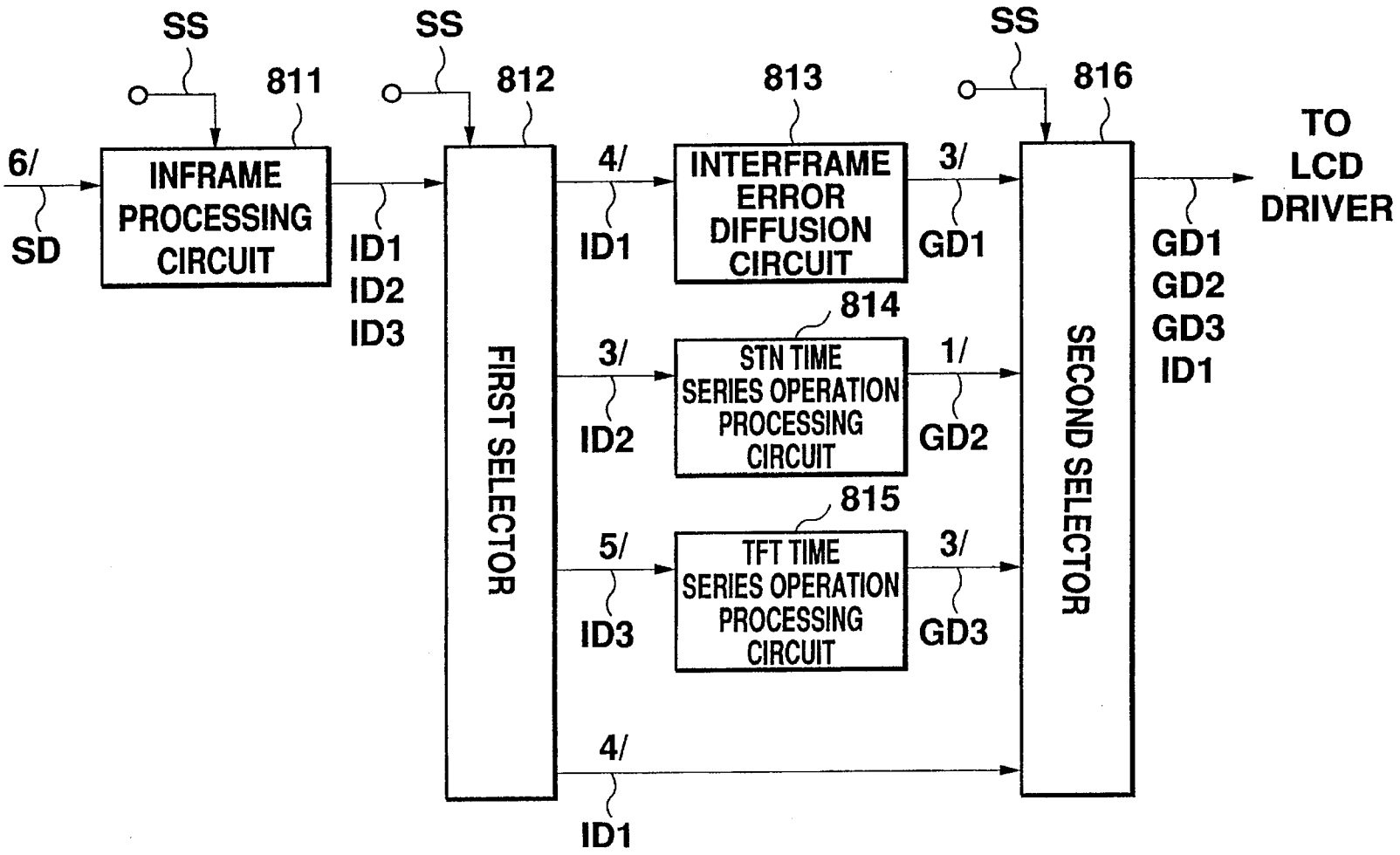
FIG. 16 is a block diagram of an image information processor according to a ninth embodiment of the invention.

In this case, in the image information processor in FIG. 16, the first selector 812 selects the interframe error diffusion circuit 813 and the second selector 816 selectively outputs first image display data (GD1); only the inframe processing circuit 811, the first selector 812, the interframe error diffusion circuit 813, and the second selector 816 are used.

As described above, the image information processor according to the ninth embodiment of the invention comprises a plurality of interframe image processors, namely, the interframe error diffusion circuit 813, STN time series operation processing circuit 814, and TFT time series operation processing circuit 815, and the first selector 812 which selects one of them. Therefore, the image information processor can execute the image information processing methods corresponding to the three types of LCD drivers conforming to the interframe error diffusion method, STN time series operation processing method, and TFT time series operation processing method.

These three methods by which image information processing is performed in a frame and then between frames are effective methods in continuous-tone image display corresponding to digital LCD drivers as the original object. According to the image information processor in the embodiment, any of these effective methods can be selected in response to the mode switch signal SS. Therefore, the number of types of LCD drivers to which the image information processor can be applied increase as compared with the conventional example in which image information processing is only performed by the interframe error diffusion method after inframe processing is performed.

The image information processor in the embodiment can also output the first internal image process data (ID1) processed in a frame to the second selector 816 intact for use as image display data.

The number of bits of data is not limited within the range in the description.

[Tenth embodiment]

Figure 21:
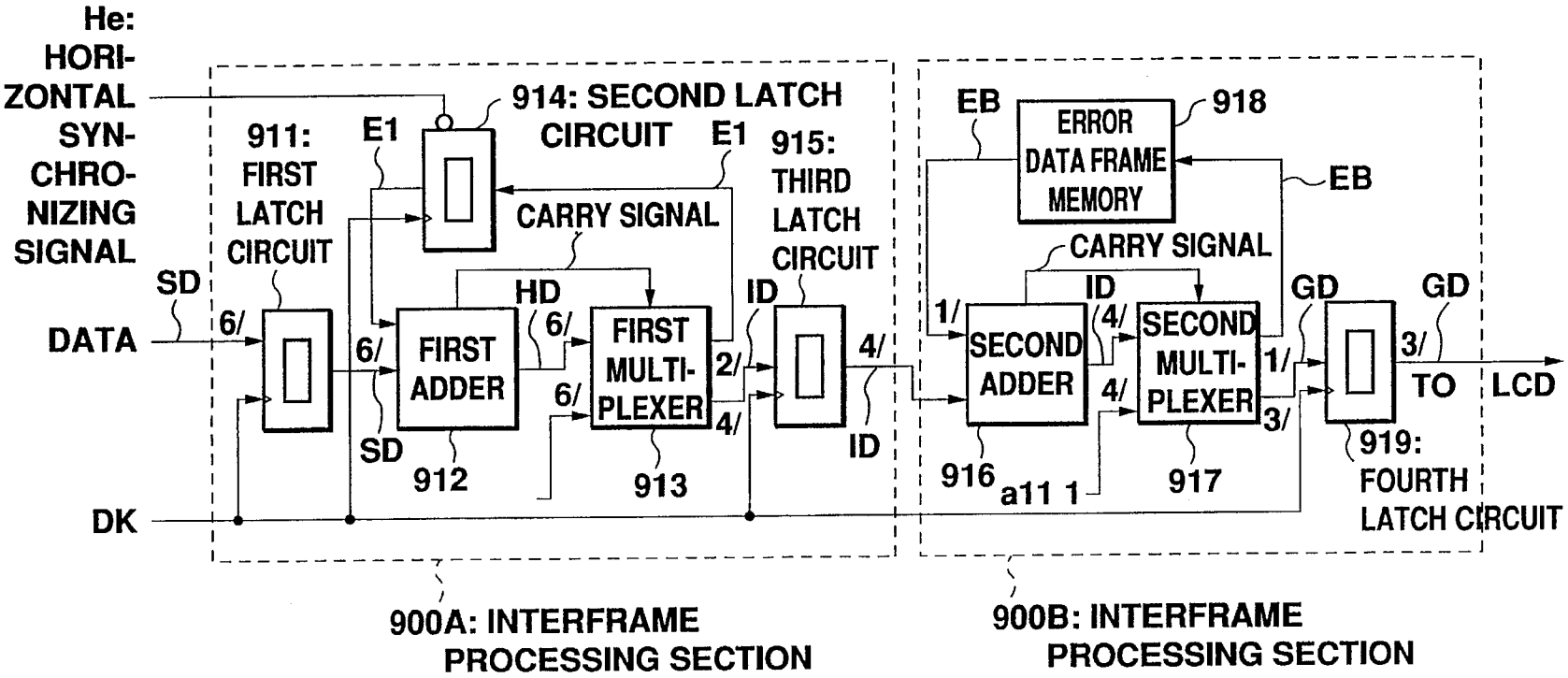
FIG. 21 is a block diagram of an image information processor according to a tenth embodiment of the invention.
Figure 22:
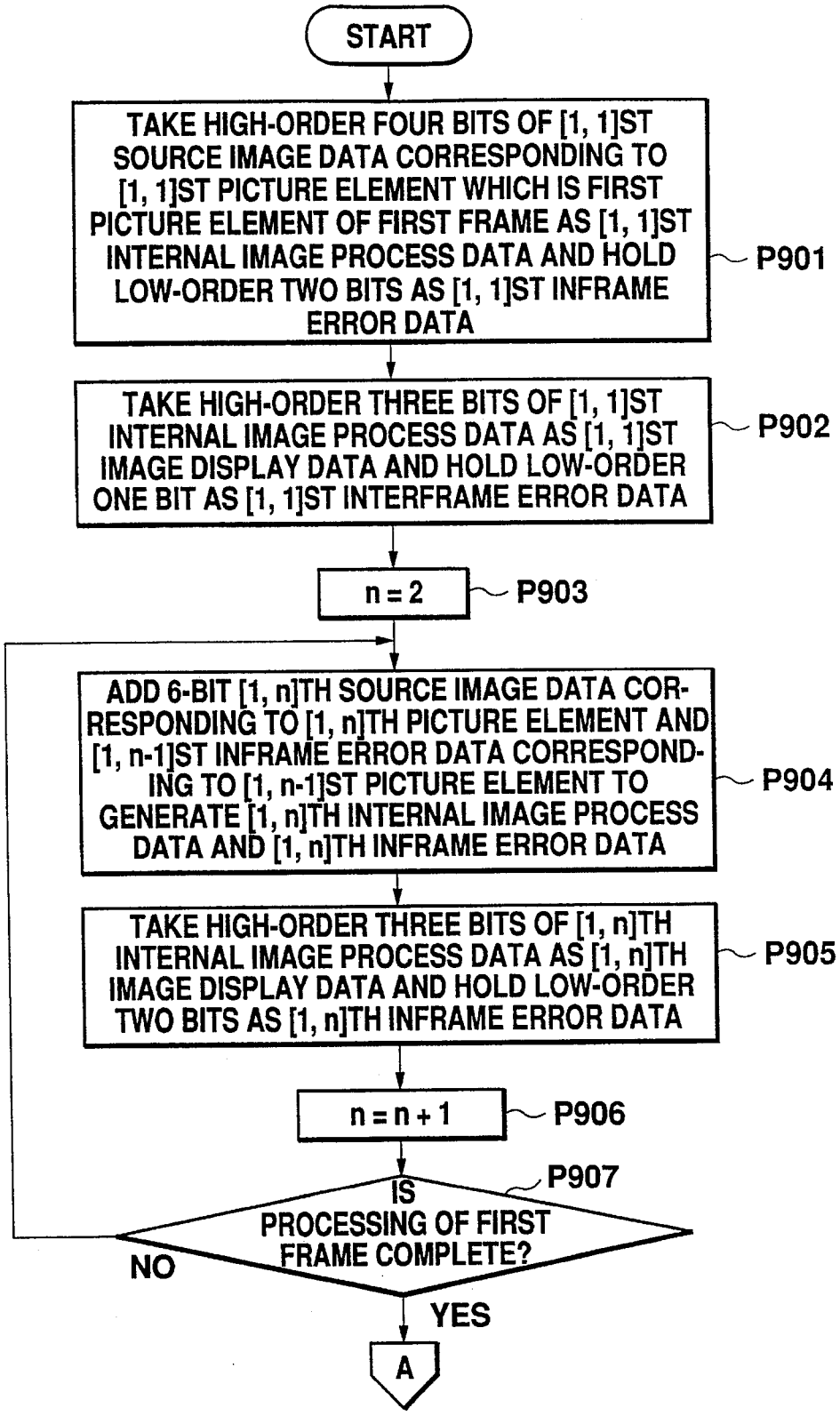
FIG. 22 is a first flowchart for describing an image information processing method according to the tenth embodiment of the invention.
Figure 23:
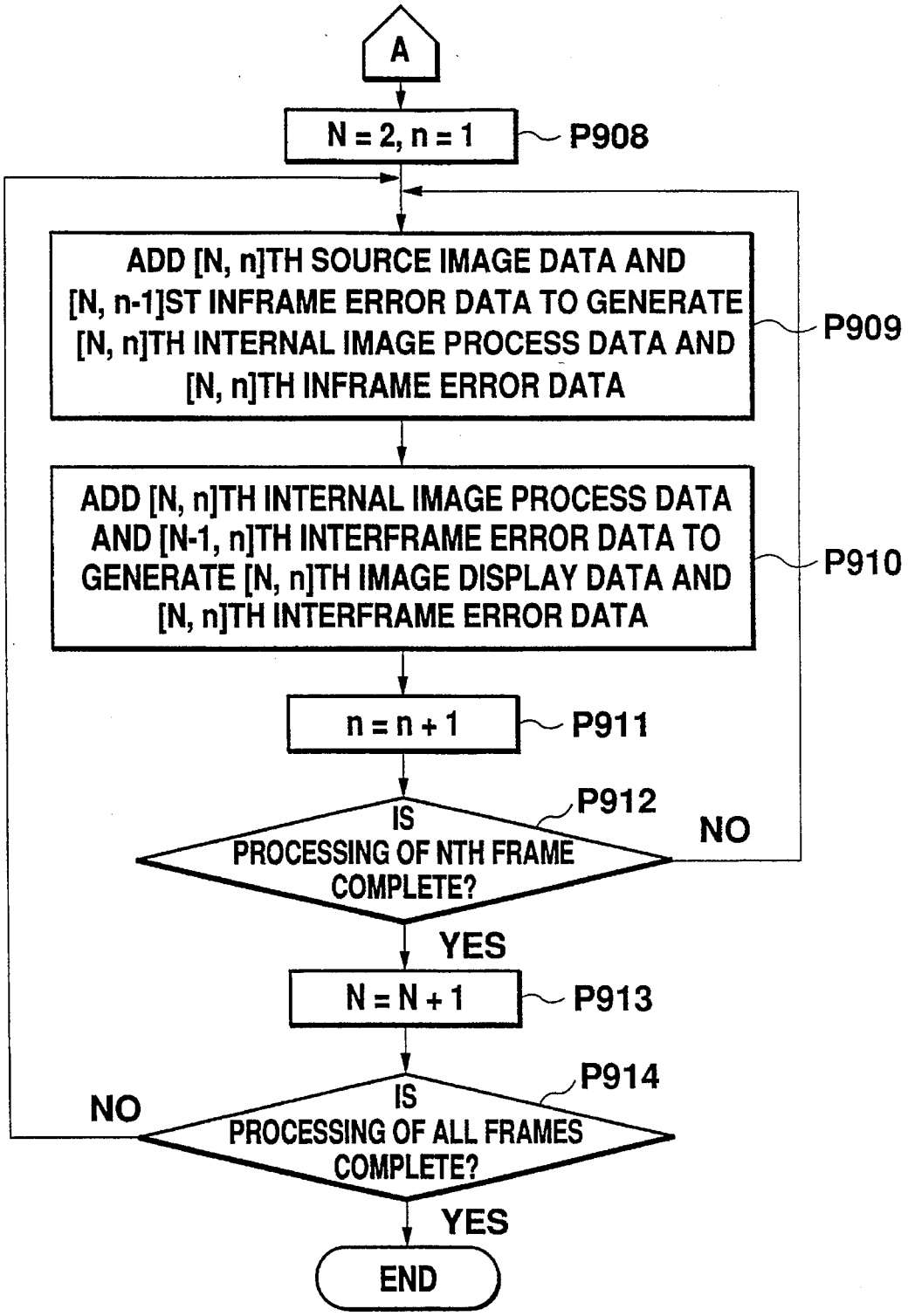
FIG. 23 is a second flowchart for describing the image information processing method according to the tenth embodiment of the invention.
Figure 24:
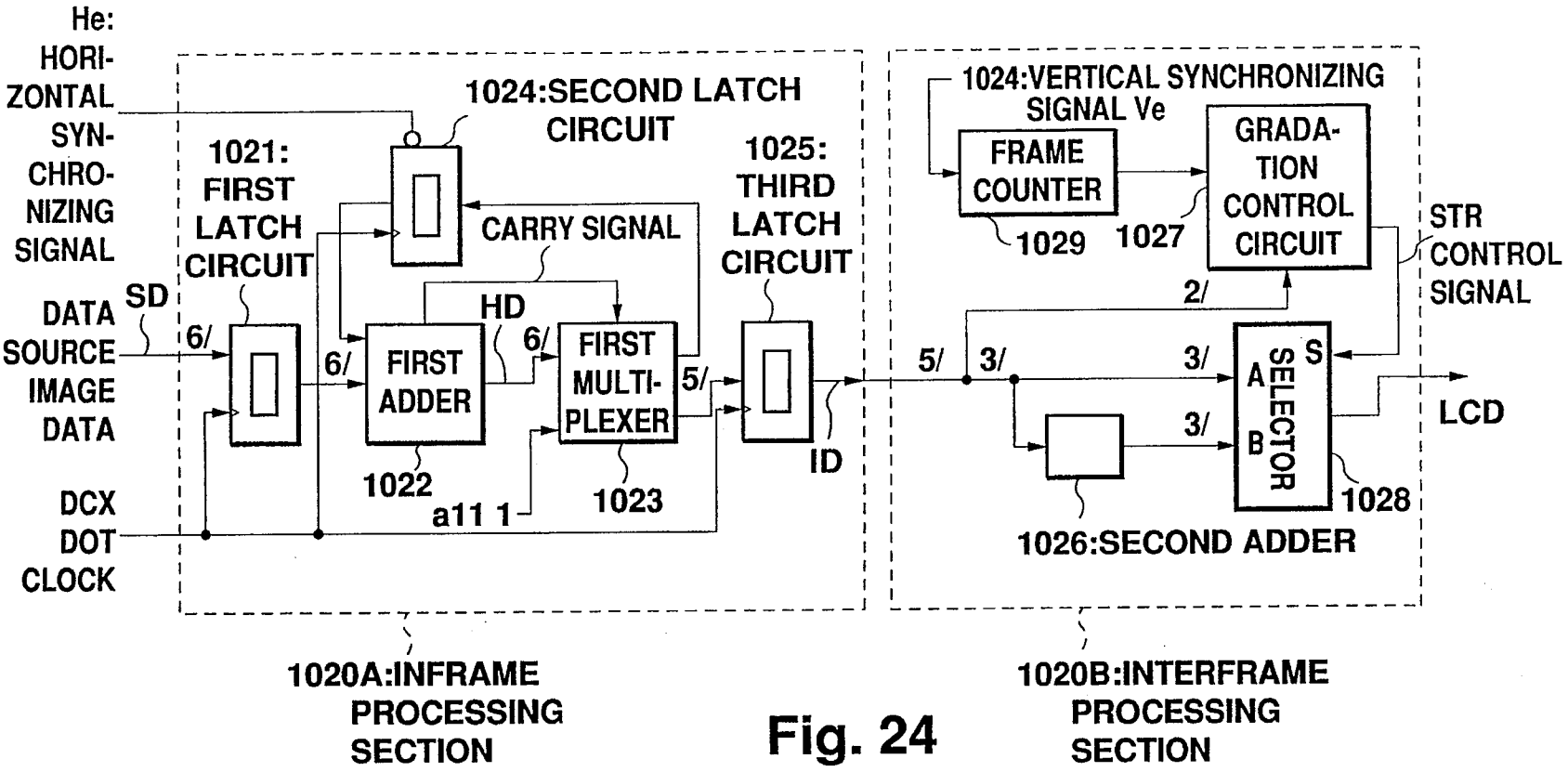
FIG. 24 is a block diagram of an image information processor according to an eleventh embodiment of the invention.

Referring now to FIGS. 21 to 23, there is shown an image information processor according to a tenth embodiment of the invention.

The image information processor according to the tenth embodiment of the invention is located between an output section which outputs source image data (not shown) and an LCD driver which drives an LCD. The image information processor compresses 6-bit source image data into 3-bit image display data and outputs it to the LCD driver which inputs 3-bit data.

The image information processor according to the tenth embodiment consists of an inframe processing section 910A and interframe processing section 910B, as shown in FIG. 21.

The inframe processing section 910A, which consists of a first latch circuit 911, a first adder 912, a first multiplexer 913, a second latch circuit 914, and a third latch circuit 915, compresses 6-bit source image data (SD) into 4-bit internal image process data (ID) for outputting to the interframe processing section 910B.

First, the functions of the components of the inframe processing section 910A are described. The first latch circuit 911 inputs 6-bit source image data (SD) and outputs it to the first adder 912 in synchronization with a dot clock (DK).

The first adder 912 adds the source image data (SD) and inframe error data (EI) read from the second latch circuit 914 to generate 6-bit correction image data (HD) and outputs the data (HD) to the first multiplexer 913.

The first multiplexer 913 divides the input 6-bit correction image data (HD) into the high-order four bits and the low-order two bits and outputs the high-order four bits or the internal image process data (ID) to the third latch circuit 915 and the low-order two bits or the inframe error data (EI) to the second latch circuit 914.

The second latch circuit 914 performs write/read processing of the 2-bit inframe error data (EI) and is initialized by a horizontal synchronizing signal He and holds the inframe error data (EI) for each picture element for the period of one picture element in synchronization with a dot clock DK.

The third latch circuit 915 outputs the input 4-bit internal image process data (ID) to a second adder 916 of the interframe processing section 910B.

Next, the interframe processing section 910B is described. The interframe processing section 910B, which consists of a second adder 916, a second multiplexer 917, an error data frame memory 918, and a fourth latch circuit 919, outputs 4-bit internal image process data (ID) input as 3-bit image display data (GD).

The second adder 916 adds 4-bit internal image process data (ID) an 1-bit interframe error data (EB) read from the error data frame memory 918 and outputs 4-bit correction data (JD) resulting from the addition to the second multiplexer 917.

The second multiplexer 917 divides the 4-bit correction data (JD) input from the second adder 916 into the high-order three bits and the low-order one bit and outputs the high-order three bits, namely, image display data (GD) to the fourth latch circuit 919 and writes the low-order one bit of the correction data (JD), namely, interframe error data (EB) into the error data frame memory 918.

The error data frame memory 918 performs write/read processing of the interframe error data (EB), the low-order one bit of correction data (JD), and holds the interframe error data (EB) for each frame for the 1-frame period.

The fourth latch circuit 919 once holds the image display data (GD) input from the second multiplexer 917 and outputs it to the external LCD driver (not shown) in response to a dot clock DK.

As described above, in the embodiment, the inframe processing section 910A adds the inframe error data (EI) to the source image data (SD) of a picture element contiguous to a picture element in one frame and divides the addition result for generating the 4-bit internal process image data (ID) and outputs the data (ID) to the interframe processing section 910B, that is, executes so-called error diffusion method. The interframe processing section 910B adds to the internal image process data (ID) of the picture element at the same position in the frame following one frame the interframe error data (EB) of the immediately preceding frame to generate 4-bit correction data (JD) and holds the low-order one bit of the correction data (JD) as interframe error data (EB) for addition to the next frame and outputs the high-order three bits to the external LCD driver (not shown) as image display data (GD).

Therefore, interframe image information processing can be performed after inframe image information processing is performed. Thus, interframe image information processing can be performed after image information processing in each frame has an effect on the frame. Therefore, the processing result in each frame is efficiently reflected in interframe image information processing; an image nearer to the source image can be displayed as compared with the conventional example in which image processing is performed only by inframe image information processing, such as the so-called error diffusion method, or interframe image information processing, such as the time series operation processing method.

The operation of the image information processor according to the tenth embodiment of the invention is described below. FIGS. 22 and 23 are flowcharts for describing the image information processing method according to the tenth embodiment.

In the description to follow, the nth picture element of the Nth frame is defined to be the [N, n]th picture element.

First, at step P901 in the flowchart of FIG. 22, the high-order four bits of the 6-bit [1, 1]st source image data (SD) corresponding to the [1, 1]st picture element which is the first picture element of the first frame are taken as the [1, 1]st internal image process data (ID) corresponding to the [1, 1]st picture element, and the low-order two bits of the [1, 1]st source image data (SD) are held as the [1, 1]st inframe error data (EI) corresponding to the [1, 1]st picture element.

At the time, the [1, 1]st source image data (SD) is input via the first latch circuit 911 to the first adder 912, and is output from the first adder 912 to the first multiplexer 913 which then divides the [1, 1]st source image data (SD) into the high-order four bits and the low-order two bits. The high-order four bits are output to the third latch circuit 915 as the [1, 1]st internal image process data (ID). The low-order two bits are output to the second latch circuit 914 for storage as the [1, 1]st inframe error data (EI).

Next, at step P902, the high-order three bits of the [1, 1]st internal image process data (ID) are taken as the [1, 1]st image display data (GD) corresponding to the [1, 1]st picture element, and the low-order one bit is held as the [1, 1]st interframe error data (EB) corresponding to the [1, 1]st picture element.

At the time, the 4-bit [1, 1]st internal image process data (ID) output from the third latch circuit 915 is sent via the second adder 916 to the second multiplexer 917 and the high-order three bits of the data (ID) are output via the fourth latch circuit 919 to the LCD driver (not shown) as the [1, 1]st image display data, and the low-order one bit is output to the error data frame memory 918 for storage as the [1, 1]st interframe error data (EB).

Next, at step P903, initial value 2 is set in n (n=2).

Next, at step P904, the 6-bit [1, n]th source image data (SD) corresponding to the [1, n]th picture element which is the nth picture element of the first frame and the [1, n−1]st inframe error data corresponding to the [1, n−1]st picture element are added to generate the [1, n]th internal image process data (ID) corresponding to the [1, n]th picture element and the [1, n]th inframe error data (EI).

At the time, the [1, n]th source image data is input via the first latch circuit 911 to the first adder 912. On the other hand, the [1, n−1]st inframe error data is read from the second latch circuit 914 in response to a dot clock (DK). Then, the first adder 912 adds both the data to generate the 6-bit [1, n]th correction image data (HD) and outputs the data (HD) to the first multiplexer 913 which then divides the [1, n]th correction image data (HD) into the high-order four bits and the low-order two bits. The high-order four bits are output to the third latch circuit 915 as the [1, n]th internal image process data (ID), and the low-order two bits are output to the second latch circuit 914 as the [1, n]th inframe error data for storage.

When a carry results from the addition by the first adder 912, data output from the first adder 912 becomes "0000XX" which differs from the value of the original image data, in which case the 6-bit value "111111" is output from the first multiplexer 913 in response to the carry signal output from the first adder 912.

Since initial value n=2 is set, at the step P904, the source image data corresponding to the [1, 2]nd picture element is input and the internal image process data (ID) and inframe error data corresponding to the [1, 2]nd picture element are generated at the beginning.

Next, at step P905, the high-order three bits of the [1, n]th internal image process data (ID) are taken as the [1, n]th image display data (GD) corresponding to the [1, n]th picture element, and the low-order one bit is taken as the [1, n]th interframe error data corresponding to the [1, n]th picture element.

At the time, the [1, n]th internal image process data (ID) output from the third latch circuit 915 is input via the second adder 916 to the second multiplexer 917.

The second multiplexer 917 outputs the high-order three bits of the [1, n]th internal image process data (ID) via the fourth latch circuit 919 to the LCD driver (not shown) as the [1, n]th image display data, and outputs the low-order one bit to the error data frame memory 918 for storage as the [1, n]th interframe error data.

Since initial value n=2 is set, at the step P905, the [1, 2]nd image display data and the [1, 2]nd interframe error data (EB) are generated at the beginning.

Next, at step P906, 1 is added to n.

Next, at step P907, whether or not processing of the first frame is complete is determined. Upon completion (Yes), control advances to step P906; upon incompletion (No), control returns to step P904 and the steps P904 and P905 are again repeated.

By repeating these steps in such a manner, the [1, 3]rd picture element, [1, 4]th picture element, . . . , [1, n]th picture element, . . . can be processed, thereby providing the image display data, inframe error data, and interframe error data of all picture elements of the first frame; meanwhile, the inframe processing section 910A executes so-called error diffusion method and the interframe processing section 910B only gets the interframe error data corresponding to each picture element used for subsequent interframe processing.

Next, at step P908 in the flowchart of FIG. 23, initial value N=2, n=1 is set. Then, the second frame is processed.

Next, at step P909, the 6-bit [N, n]th source image data (SD) corresponding to the [N, n]th picture element and the [N, n−1]st inframe error data are added to generate the [N, n]th internal image process data (ID) and the [N, n]th inframe error data (EI).

At the time, the [N, n]th source image data (SD) is input via the first latch circuit 911 to the first adder 912. On the other hand, the [N, n−1]st Inframe error data (EI) is read from the second latch circuit 914 in response to a dot clock (DK). Then, the first adder 912 adds both the data to generate the 6-bit [N, n]th correction image data and outputs the data to the first multiplexer 913. The first multiplexer 913 divides the [N, n]th correction image data into the high-order four bits and the low-order two bits. The high-order four bits are output to the third latch circuit 915 as the [N, n]th internal image process data (ID), and outputs the low-order two bits to the second latch circuit 914 for storage as the [N, n]th inframe error data (EI).

When a carry results from the addition by the first adder 912, data output from the first adder 912 becomes "0000XX" which differs from the value of the original image data, in which case the 6-bit value "111111" is output from the first multiplexer 913 in response to the carry signal output from the first adder 912. Since initial value N=2, n=1 is set, at the beginning, the source image data corresponding to the [2, 1]st picture element is input and the internal image process data (ID) and inframe error data (EI) corresponding to the [2, 1]st picture element are generated.

Next, at step P910, the [N, n]th internal image process data (ID) and the [N−1, n]th interframe error data (EB) are added to generate the [N, n]th image display data and the [N, n]th interframe error data (EB) corresponding to the [N, n]th picture element.

At the time, the 4-bit [N, n]th internal image process data (ID) output from the third latch circuit 915 is input to the second adder 916. At the same time, the 1-bit [N−1, n]th interframe error data (EB) is read from the error data frame memory 918 into the second adder 916. Then, the second adder 916 adds [N, n]th internal image process data (ID1) and [N−1, n]th interframe error data (EB) to generate 4-bit [N, n]th correction data (JD) and outputs the data (JD) to the second multiplexer 917.

The second multiplexer 917 outputs the high-order three bits of the 4-bit [N, n]th correction data (JD) via the fourth latch circuit 919 to the LCD driver (not shown) as the [N, n]th image display data, and outputs the low-order one bit to the error data frame memory 918 for storage as the [N, n]th interframe error data.

At the step P910, as a result of a carry by the addition by the second adder 916, data output from the second adder 916 becomes "000X" which differs from the value of the original image data, in which case the 4-bit value "1111" is output from the second multiplexer 917 in response to the carry signal output from the second adder 916.

Next, at step P911, 1 is added to n.

Next, at step P912, whether or not processing of the Nth frame is complete is determined. Upon completion (Yes), control advances to step P913; upon incompletion (No), control returns to step P909 and the steps P909-P911 are again repeated.

Next, at step P914, whether or not processing of all frames is complete is determined. Upon completion (Yes), the processing is terminated; upon incompletion (No), control returns to step P909 and the steps are again repeated.

These steps are repeated in such a manner, thereby performing information processing for each picture element in the order of the [2, 1]st picture element, [2, 2]nd picture element, . . . , [2, n]th picture element, [3, 1]st picture element, [3, 2]nd picture element, [3, n]th picture element, . . . , [N, 1]st picture element, [N, 2]nd picture element, . . . , [N, n]th picture element; image information processing can be performed for all frames on and after the second frame; meanwhile, the inframe processing section 910A executes so-called error diffusion method, and the interframe processing section 910B adds the interframe error data corresponding to each picture element to the internal image process data of the picture element of the next frame at the same position as that picture element.

As described above, the inframe error data (EI) of one picture element and the source image data (SD) of the contiguous picture element are added to generate internal image process data (ID) on which image display data (GD) is based, thus the image display brightness difference lessens between two contiguous picture elements, such as the [3, 1]st and [3, 2]nd picture elements, and the image brightness depending on the position is smoothed, thereby preventing so-called pseudo contour, etc.

Then, the interframe error data (EB) of one picture element and the internal image process data (ID) of the picture element of the next frame at the same position as that picture element are added to generate image display data (GD), thus the brightness difference from the picture element of the next frame lessens and a time change in brightness lessens, thereby stabilizing the image.

Further, error data of one picture element is added to the contiguous picture element and the picture element of the next frame at the same position as that picture element in sequence, thereby changing the image brightness any time. If the number of bits of the error data is increased, improvement in the continuous-tone image display capability can be intended on theory as desired, enabling an image nearer to the source image to be displayed.

Flickering caused when time series information patterns are changed in the conventional example in which only time series operation processing is performed for image information processing can also be prevented.

[Eleventh embodiment]

Referring now to FIGS. 21 to 24, there is shown an image information processor according to an eleventh embodiment of the invention.

The image information processor according to the eleventh embodiment of the invention is located between an output section which outputs source image data (not shown) and an LCD driver which drives an LCD. The image information processor compresses 6-bit source image data into 3-bit image display data and outputs it to the LCD driver which inputs 3-bit data.

The image information processor according to the eleventh embodiment consists of an inframe processing section 1020A and interframe processing section 1020B, as shown in FIG. 46.

The inframe processing section 1020A, which consists of a first latch circuit 1021, a first adder 1022, a first multiplexer 1023, a second latch circuit 1024, and a third latch circuit 1025, compresses 6-bit source image data (SD) into 5-bit internal image process data (ID) for outputting to the interframe processing section 1020B, that is, executes so-called error diffusion method. The function of the inframe processing section 1020A is the same as that of the inframe processing section 910A in the tenth embodiment and will therefore not be discussed again.

The interframe processing section 1020B, which consists of a second adder 1026, a gradation control circuit 1027, a selector 1028, and a frame counter 1029, performs time series operation processing of 5-bit internal image process data (ID) input and then outputs 3-bit image display data (GD).

The second adder 1026 adds 1 to the high-order 3-bit data of S-bit internal image process data (ID) output from the third latch circuit 1025.

The gradation control circuit 1027 generates a control signal (STR) for controlling an output of the selector 1028 from the low-order 2-bit data of 5-bit internal image process data (ID) output from the third latch circuit 1025 and the frame number output from the frame counter 1029.

The selector 1028 selectively outputs either the high-order 3-bit data of the internal image process data (ID) or the 3-bit data to which 1 is added, in response to the control signal STR.

The frame counter 1029 assigns four numbers 0 to 3 to frames and outputs the numbers to the gradation control circuit 1027.

As described above, with the image information processor according to the embodiment, the inframe processing section 1020A performs image information processing in one frame by the so-called error diffusion method and the interframe processing section 1020B performs interframe processing by time series operation processing.

Therefore, interframe image information processing can be performed after inframe image information processing is performed, as with the tenth embodiment. Thus, interframe image information processing can be performed after image information processing in each frame has an effect on the frame.

The low-order bits are processed in each frame, and the processing period of the interframe processing section can be shortened as compared with the case in which the same number of data pieces are processed in time series processing; flickering can be prevented. Thus, the processing result in each frame is efficiently reflected in interframe image information processing; an image nearer to the source image can be displayed.

As described above, according to the image information processing method in the eleventh embodiment, the so-called error diffusion method is used by which the error data of one picture element is added to the contiguous picture element, thus the image display brightness difference lessens between the two contiguous picture elements, and the image brightness depending on the position is smoothed, thereby preventing so-called pseudo contour, etc.

Then, time series operation processing is furthermore performed for more continuous-tone image display (in the embodiment, the number of scales increases four times), thereby enabling an image nearer to the source image to be displayed as compared with the conventional examples in which only the error diffusion method is used for continuous-tone image display.

What is claimed is:

1. An image information processor for generating display data which is applied to a display to produce an image composed of a succession of frames, each frame containing an array of picture elements, or pixels, the display data for each pixel being composed of L image display bits, where L is a natural number equal to or greater than 2, and for causing the image to present pseudo representations of gradations represented by P image data bits, where P is a natural number greater than L, said image information processor comprising:

(a) addition means, when it is assumed that N is a natural number of 2 or greater, for adding error data of a picture element of an (N–1)st frame to the corresponding picture element data of an Nth frame;

(b) information selection means for outputting high-order L bits of P-bit data provided by said addition means as image display data of the Nth frame and at least one bit of the remaining (P–L) bits as error data of the picture element of the Nth frame;

(c) means for storing said error data;

(d) means for calculating a difference between source image data of the (N–1)st frame and the corresponding source image data of the Nth frame; and (e) comparison means for determining whether or not the difference exceeds a predetermined value, wherein when the difference exceeds the predetermined value, said information selection means does not output the image display data and outputs the high-order L bits of the source image data of the Nth frame as the image display data of the Nth frame.

2. The image information processor as claimed in claim 1 further including information clear means for clearing the error data every given number of frames.

3. The image information processor as claimed in claim 2 wherein the error data are composed of n bits, a value of $a\times2^n$ is set in said information clear means, where a is a selected constant and n and a are natural numbers, and said information clear means clears the error data every $a\times2^n$ frames on the basis of the value set in said information clear means.

4. An image information processor for generating display data which is applied to a display to produce an image composed of a succession of frames, each frame containing an array of picture elements, or pixels, the display data for each pixel being composed of L image display bits, where L is a natural number equal to or greater than 2, and for causing the image to present pseudo representations of gradations represented by P image data bits, where P is a natural number greater than L, said image information processor comprising:

(a) addition means, when it is assumed that N is a natural number of 2 or greater, for adding error data of a picture element of an (N–1)st frame to the corresponding picture element data of an Nth frame;

(b) information selection means for outputting high-order L bits of P-bit data provided by said addition means as image display data of the Nth frame and at least one of the high-order bits of the remaining (P–L) bits as error data of the picture element of the Nth frame;

(c) means for storing said error data; and (d) information clear means for clearing the error date every given number of frames.

5. The image information processor as claimed in claim 4 wherein the error data are composed of n bits, a value of $a\times2^n$ is set in said information clear means, where a is a selected constant and n and a are natural numbers, and said information clear means clears the error data every $a\times2^n$ frames on the basis of the value set in said information clear means.

6. The image information processor as claimed in claim 4 further including information clear means for clearing the error data every plurality of lines while changing the lines according to frames.

7. The image information processor as claimed in claim 4 wherein said information selection means output only high-order L bits of P-bit data provided by said addition means and only at least one of the high-order bits of the remaining (P–L) bits as error data of the picture element of the Nth frame.

* * * * *